US007909431B2

(12) United States Patent
Taira

(10) Patent No.: US 7,909,431 B2
(45) Date of Patent: Mar. 22, 2011

(54) IMAGE RECORDING APPARATUS

(75) Inventor: Hiroshi Taira, Ichinomiya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 169 days.

(21) Appl. No.: 12/180,890

(22) Filed: Jul. 28, 2008

(65) Prior Publication Data

US 2009/0027446 A1 Jan. 29, 2009

(30) Foreign Application Priority Data

Jul. 26, 2007 (JP) ..... 2007-194078

(51) Int. Cl.
*B41J 2/165* (2006.01)

(52) U.S. Cl. ..... 347/33; 347/22; 347/23; 347/29; 347/32; 347/34; 347/35

(58) Field of Classification Search ..... 347/22, 347/29, 33, 23, 32, 34, 35
See application file for complete search history.

(56) References Cited

U.S. PATENT DOCUMENTS

| | | | | |
|---|---|---|---|---|
| 2003/0081042 | A1* | 5/2003 | Wotton et al. | 347/22 |
| 2003/0081055 | A1 | 5/2003 | Wotton et al. | |
| 2005/0122374 | A1* | 6/2005 | Lim et al. | 347/33 |
| 2006/0203030 | A1 | 9/2006 | Tobita et al. | |
| 2006/0274108 | A1 | 12/2006 | Shimizu | |
| 2007/0085873 | A1* | 4/2007 | Jung | 347/22 |
| 2009/0027445 | A1 | 1/2009 | Chikamoto | |
| 2009/0027447 | A1 | 1/2009 | Chikamoto et al. | |

FOREIGN PATENT DOCUMENTS

| | | | |
|---|---|---|---|
| EP | 1518689 | A1 | 3/2005 |
| JP | H10-095114 | A | 4/1998 |
| JP | 2003-001855 | A | 1/2003 |
| JP | 2006247844 | A | 9/2006 |
| JP | 2009-028972 | A | 2/2009 |
| JP | 2009-028973 | A | 2/2009 |
| JP | 2009-028974 | A | 2/2009 |

OTHER PUBLICATIONS

European Patent Office, European Search Report for Related Application No. EP 08013486, mailed Nov. 24, 2008.

* cited by examiner

*Primary Examiner* — Charlie Peng
*Assistant Examiner* — Hung Lam
(74) *Attorney, Agent, or Firm* — Baker Botts L.L.P.

(57) ABSTRACT

An image recording apparatus includes liquid ejection heads, wipers, and a movement means. The liquid ejection heads respectively have ejection faces, and are arranged in such a manner that the ejection faces form two rows extending in one direction and in addition two of the ejection faces included in different rows do not overlap each other along a direction perpendicular to the one direction. The liquid ejection heads are divided into one or more head groups each including two of the liquid ejection heads corresponding to the different rows. The movement means moves two of the wipers associated with two liquid ejection heads belonging to each head group, from inner end portions of the ejection faces in opposite directions along the perpendicular direction while keeping the two wipers in contact with the ejection faces.

8 Claims, 9 Drawing Sheets

IMAGE RECORDING APPARATUS

CROSS REFERENCE TO RELATED APPLICATION

The present application claims priority from Japanese Patent Application No. 2007-194078, which was filed on Jul. 26, 2007, the disclosure of which is herein incorporated by reference in its entirety.

BACKGROUND OF THE INVENTION

1. Field of the Invention

The present invention relates to an image recording apparatus having a liquid ejection head which ejects liquid.

2. Description of Related Art

Japanese Unexamined Patent Publication No. 2006-247844 discloses an ink-jet printer including four ink-jet heads and a maintenance unit. The four ink-jet heads, each of which is elongated in a direction perpendicular to a paper conveyance direction, are arranged side by side in the paper conveyance direction. The maintenance unit performs maintenance on the four ink-jet heads. In the ink-jet printer, the maintenance unit has a support member, a blade (wiper), a wipe roller, and an ink receiver. The support member is horizontally movable in the direction perpendicular to the paper conveyance direction. The blade (wiper), the wipe roller, and the ink receiver are mounted on the support member. While the support member is located in a maintenance position opposed to the four ink-jet heads, a purge operation is performed to eject ink from nozzles of the ink-jet heads onto the support member. Then, while the ink receiver, the wipe roller, and the blade is moving together with the support member from the maintenance position to the withdrawal position, they sequentially get opposed to ink ejection faces to absorb and wipe off ink. In this way, maintenance is performed on the four ink-jet heads.

In a case where wipe-off of ink is ended in the middle of the ink ejection face, ink collected by the blade is accumulated to form an ink pool at a point of ending. If ink droplets accidentally drop from the ink pool, ink adheres to a conveyor belt or a paper being conveyed on the conveyor belt, to contaminate the conveyor belt or the paper.

SUMMARY OF THE INVENTION

An object of the present invention is to provide an image recording apparatus which can suppress contamination of a recording medium and/or a recording medium conveyance mechanism.

According to an aspect of the present invention, there is provided an image recording apparatus comprising: a plurality of liquid ejection heads respectively having ejection faces which are arranged in such a manner that the ejection faces form two rows extending in one direction and in addition two of the ejection faces included in different rows do not overlap each other along a direction perpendicular to the one direction with respect to an in-plane direction of the ejection faces, the plurality of liquid ejection heads being divided into one or more head groups each including two of the liquid ejection heads corresponding to the different rows; a recording medium conveyance mechanism which conveys a recording medium in the one direction while making the recording medium opposed to the ejection faces; a plurality of wipers which wipe the ejection faces of the liquid ejection heads; and a movement means which moves two of the wipers for wiping two ejection faces of the two liquid ejection heads belonging to each head group, in opposite directions along the perpendicular direction while keeping the two wipers in contact with the ejection faces, in such a manner that each of the wipers moves outward from an inner end portion of the ejection face located in a region where no droplet is ejected and which is close to a center with respect to the perpendicular direction, to a position which overlaps, along the vertical direction, at least either one of an outside region of a conveyance region where the recording medium is conveyed by the recording medium conveyance mechanism and an outside region of the recording medium conveyance mechanism.

In this aspect, a plurality of liquid ejection heads are arranged in such a manner that a plurality of ejection faces of the plurality of liquid ejection heads form two rows along one direction and two ejection faces included in different rows do not overlap each other along the perpendicular direction. When two wipers associated with two ejection faces included in different rows wipe the ejection faces, each of the wipers moves along the perpendicular direction from the inner end portion of the ejection face to a position which overlaps, along the vertical direction, at least either one of an outside region of a conveyance region where the recording medium is conveyed by the recording medium conveyance mechanism and an outside region of the recording medium conveyance mechanism. Accordingly, even if liquid drops from a liquid pool which is formed of liquid collected by the wipers, contamination of the recording medium conveyance mechanism and/or the recording medium can be suppressed.

BRIEF DESCRIPTION OF THE DRAWINGS

Other and further objects, features and advantages of the invention will appear more fully from the following description taken in connection with the accompanying drawings in which.

DESCRIPTION OF THE PREFERRED EMBODIMENTS

Figure 1:
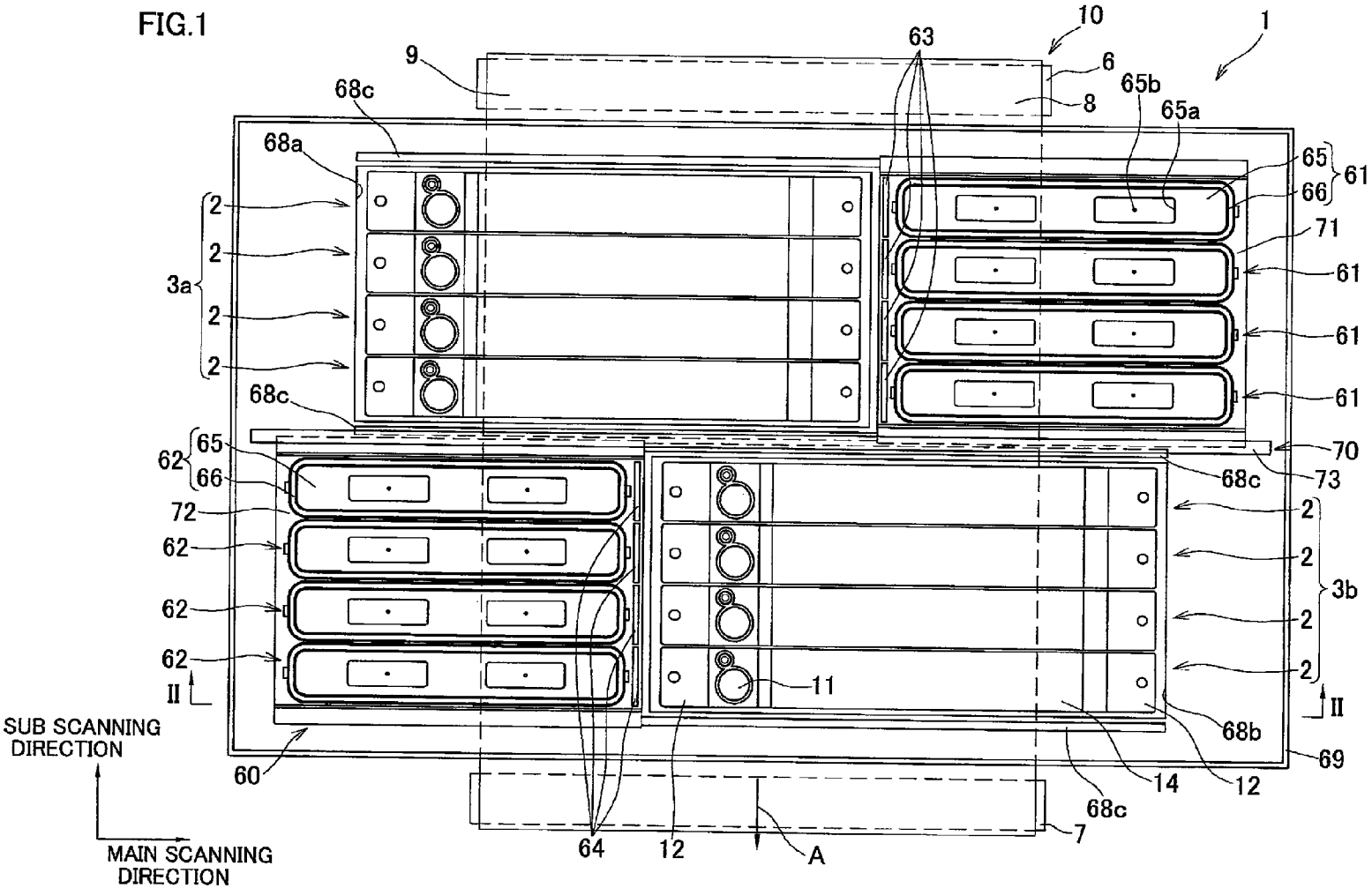
FIG. 1 is a plan view of an essential part of an ink-jet printer according to a first embodiment of the present invention.
Figure 2:
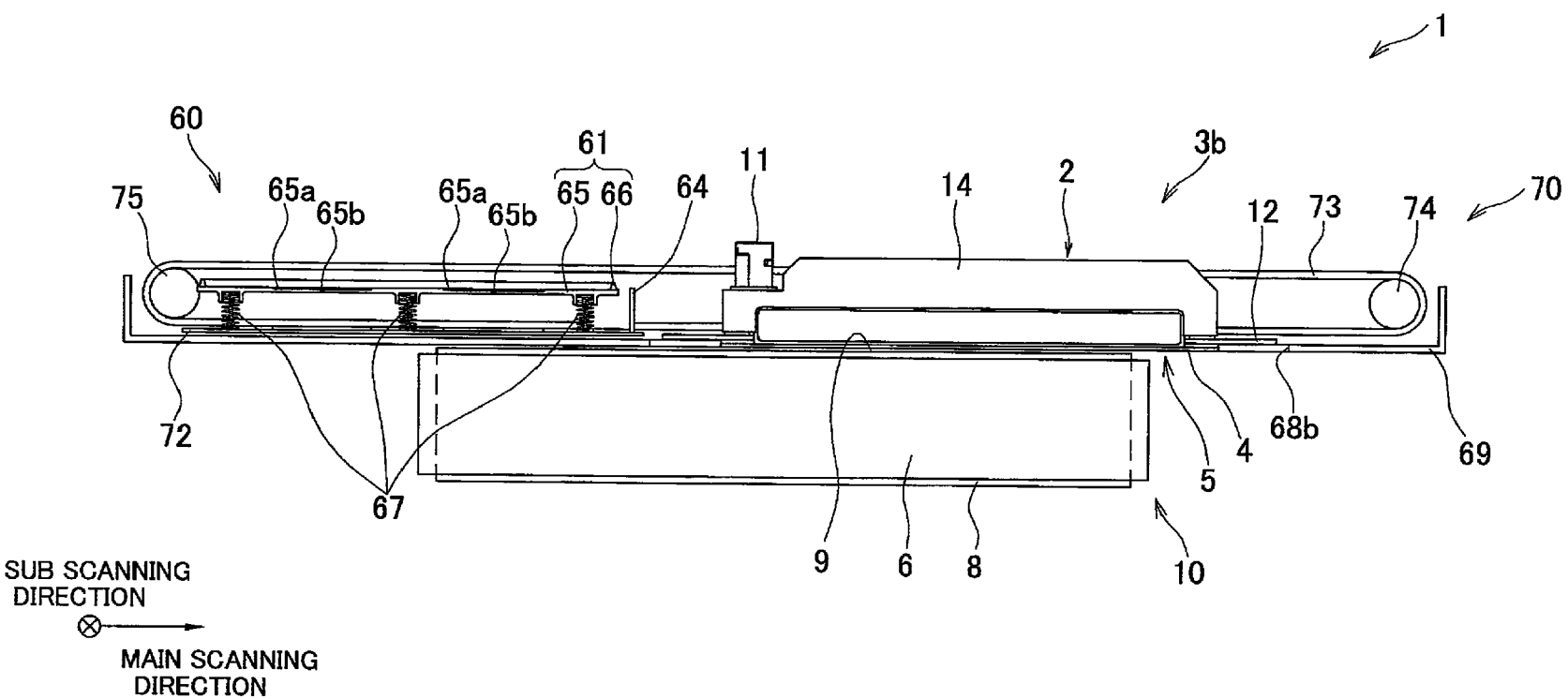
FIG. 2 is a sectional view as taken along line II-II illustrated in FIG. 1.
Figure 3:
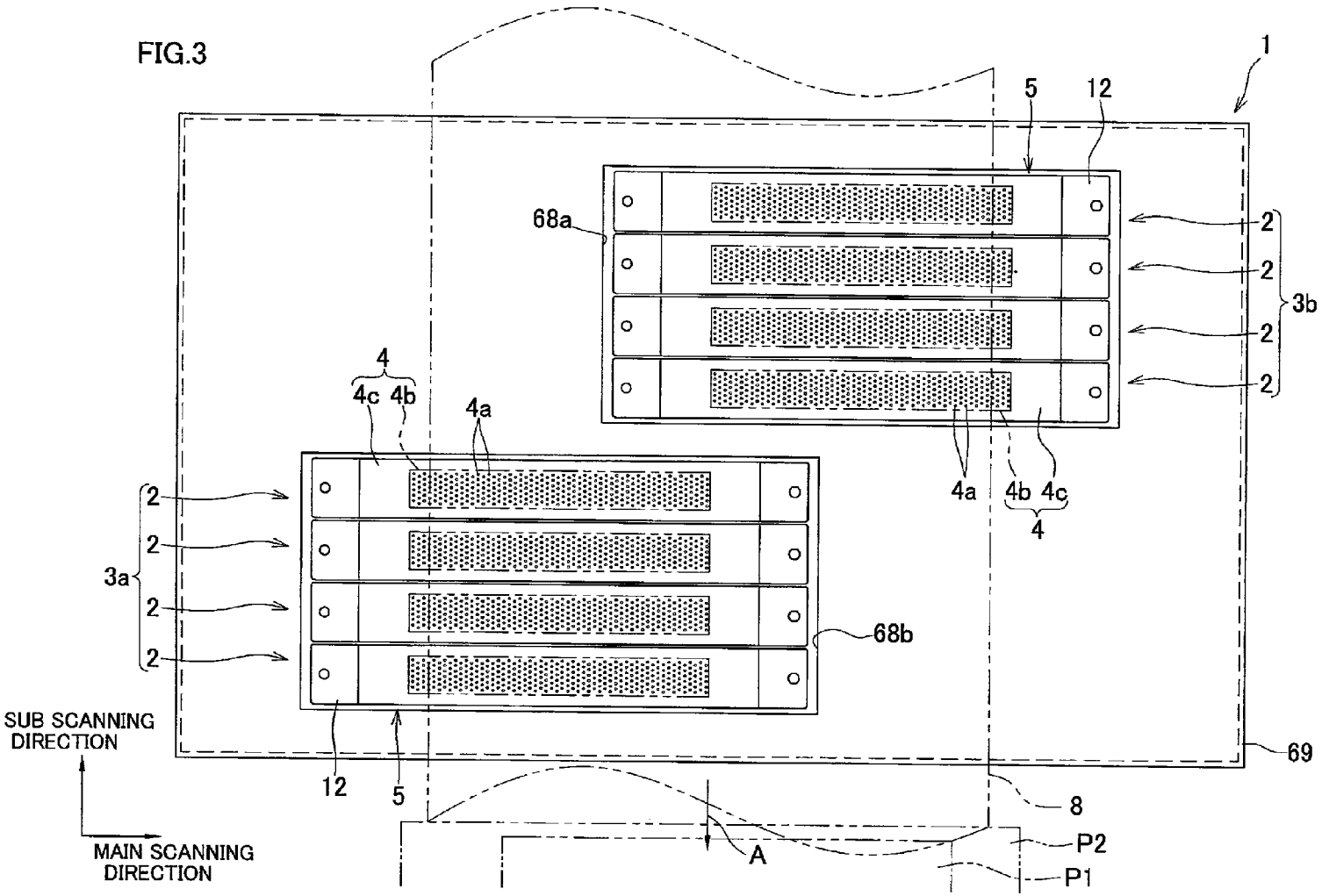
FIG. 3 shows two head groups illustrated in FIG. 1, as seen from a bottom side thereof.

FIG. 1 is a plan view of an essential part of an ink-jet printer according to a first embodiment of the present invention. FIG. 2 is a sectional view as taken along line II-II illustrated in FIG. 1. FIG. 3 shows two head groups illustrated in FIG. 1, as seen from a bottom side thereof.

As shown in FIG. 1, an ink-jet printer 1, which is an image recording apparatus of this embodiment, is a color ink-jet printer of line type including two head groups 3*a* and 3*b* each of which is made up of four ink-jet heads 2 or liquid ejection heads. The ink-jet printer 1 has a paper feed unit (not shown) and a paper discharge unit (not shown) at upper and lower parts of FIG. 1, respectively.

In the ink-jet printer 1, a paper conveyance mechanism 10 which is a recording medium conveyance mechanism is provided between the paper feed unit and the paper discharge unit, at a position opposed to the two head groups 3*a* and 3*b*. The paper conveyance mechanism 10 conveys a paper as a recording medium to a position opposed to ink ejection faces 4 which are ejection faces of the eight ink-jet heads 2. As shown in FIG. 1, the paper conveyance mechanism 10 has a pair of belt rollers 6 and 7 which are disposed so as to sandwich the two head groups 3*a* and 3*b* with respect to the sub scanning direction (i.e., an up-and-down direction in FIG. 1), and an endless conveyor belt 8 which is wound on the pair of belt rollers 6 and 7 to be stretched therebetween. A conveyor motor 97 (see FIG. 4) applies driving force to the belt roller 7 which is thereby rotated in a predetermined direction. As the belt roller 7 rotates in the predetermined direction, the conveyor belt 8 travels so as to convey the paper in a paper conveyance direction A (i.e., in a direction from up to down in FIG. 1).

The conveyor belt 8 has a two-layer structure made up of a base material and urethane rubber. An outer surface of the conveyor belt 8, that is, a conveyor face 9 has adhesiveness. A paper fed out from the paper feed unit is maintained due to the adhesiveness of the conveyor face 9, and in this condition conveyed in the conveyance direction A.

Each ink-jet head 2 has a rectangular parallelepiped shape elongated in a main scanning direction (which is a direction perpendicular to the paper conveyance direction A: a perpendicular direction), as shown in FIGS. 1 and 2. Each ink-jet head 2 has a head main body 5 at its lower end.

A reservoir unit which temporarily stores ink therein is fixed to an upper face of the head main body 5. The reservoir unit is partially covered with a cover 14. Referring to FIG. 1, a tube joint 11 is connected to a left end of the reservoir unit. Ink supplied through the tube joint 11 is stored in an ink reservoir which is formed within the reservoir unit. The reservoir unit is longer than the head main body 5 with respect to the main scanning direction. Portions 12 of the reservoir unit extend out on both sides of the reservoir unit with respect to the main scanning direction. The portions 12 serve as a fixing portion to be fixed to an elevation frame (not shown). All of the ink-jet heads 2 are fixed to the elevation frame via the fixing portion. The elevation frame can be moved up and down by a head elevation mechanism 98 (see FIG. 4).

Normally, the eight ink-jet heads 2 are disposed in a printing position (i.e., a position of the ink-jet head 2 shown in FIG. 2). When the ink-jet heads 2 are in the printing position, each ink ejection face 4 and the conveyor face 9 of the conveyor belt 8 extend in parallel with each other and at a predetermined interval therebetween. With this structure, while a paper conveyed by the conveyor belt 8 is passing immediately below the eight head main bodies 5 sequentially, a desired image is formed on the paper. For a maintenance operation on the ink-jet head 2, on the other hand, the head elevation mechanism 98 moves up the elevation frame. This brings the eight ink-jet heads 2 fixed to the elevation frame into a head maintenance position (see FIG. 5A) which is above and away from the printing position.

As shown in FIG. 3, small-diameter nozzles 4*a* which eject ink, an ink ejection region 4*b* which is formed by a collection of the nozzles 4*a*, and an outside region 4*c* which surrounds the ink ejection region 4*b* are provided on a bottom face of the head main body 5, that is, on the ink ejection face 4 of the ink-jet head 2.

As shown in FIGS. 1 and 3, the eight ink-jet heads 2 are arranged in a zigzag pattern in such a manner that the ink ejection faces 4 form two rows each including four ink ejection faces 4 which are arranged side by side along the sub scanning direction and in addition the ink ejection faces 4 included in different rows do not overlap each other with respect to the main scanning direction. The eight ink-jet heads 2 are divided into two head groups 3*a* and 3*b* each of which includes four ink-jet heads 2. Neighboring ink ejection faces 4 of the four ink-jet heads 2 are adjacent to each other with respect to the sub scanning direction (a direction parallel to the conveyance direction A: one direction) without misalignment in the main scanning direction.

The two head groups 3*a* and 3*b* are arranged in a zigzag pattern with their positions staggered. The ink ejection faces 4 in one of the two head groups 3*a* and 3*b* and the ink ejection faces 4 in the other of the two head groups 3*a* and 3*b* overlap each other along the sub scanning direction, so that print regions (i.e., ink ejection regions 4*b*) in the respective head groups 3*a* and 3*b* for making printing on a paper continue in the main scanning direction.

More specifically, the ink-jet heads 2 are arranged in such a manner that an interval in the main scanning direction between neighboring nozzles 4*a* existing in one ink ejection region is the same as an interval in the main scanning direction between an innermost (i.e., rightmost in FIG. 3) one of the nozzles 4*a* formed in the ink ejection face 4 in the head group 3*a* and an innermost (i.e., leftmost in FIG. 3) one of the nozzles 4*a* formed in the ink ejection face 4 in the head group 3*b*.

The four ink-jet heads 2 belonging to each of the head groups 3*a* and 3*b* eject ink of four different colors (magenta, yellow, cyan, and black).

Next, a maintenance unit 60 which performs maintenance on the ink-jet heads 2 will be described. As shown in FIGS. 1 and 2, the maintenance unit 60 has four caps 61 and four wipers 63, four caps 62 and four wipers 64, a movement mechanism 70, and a tray 69. The four caps 61 and four wipers 63 are associated with four ink-jet heads 2 which belong to the head group 3*a*. The four caps 62 and four wipers 64 are associated with four ink-jet heads 2 which belong to the head group 3*b*. The movement mechanism 70 is a part of a movement means which moves the four caps 61 and wipers 63, and four caps 62 and wipers 64 in opposite directions along the main scanning direction. The tray 69 contains therein the eight caps 61 and 62, the eight wipers 63 and 64, and the movement mechanism 70.

The tray 69 has pass throughs 68*a* and 68*b* which extend through the tray 69 in a vertical direction. The pass throughs 68*a* and 68*b* are at positions opposed to the respective head groups 3*a* and 3*b*. Each of the pass throughs 68*a* and 68*b* has a rectangular shape in a plan view, and has such a size that the four ink ejection faces 4 in each of the head groups 3*a* and 3*b* can entirely be opposed to the conveyor face 9.

The caps 61 and 62 have the same shape and the same size, and each of them is made up of a base material 65 and an annular protrusion 66. A shape of the base material 65 is similar to but slightly larger than the ink ejection region 4*b*. The annular protrusion 66 stands at a periphery of the base material 65. This structure allows the caps 61 and 62 to cover the ink ejection regions 4*b* with distal ends of the annular protrusions 66 being in contact with the outside regions 4*c* of the ink ejection faces 4. Thereby, drying of ink existing within the nozzles 4*a* can be suppressed.

Two recesses 65*a* which open upward in the vertical direction are formed in the base material 65. The two recesses 65*a* are disposed side by side along the main scanning direction. A through hole 65*b* is formed at a bottom of the recess 65*a*. Since the through holes 65*b* are formed, ink ejected into the caps 61, 62 in a purge operation and collected within the recess 65*a* can be discarded through the through holes 65*b* into a not-shown waste ink reservoir.

As shown in FIG. 2, each of the caps 61, 62 is supported from below by three springs 67. Since each of the caps 61, 62 is supported by the three springs 67, impact caused when the annular protrusion 66 comes into contact with the ink ejection face 4 can be softened, so that the ink ejection face 4 is not easily damaged by the annular protrusion 66.

The maintenance unit 60 also has a cap level adjusting mechanism 99 (see FIG. 4) which moves down the caps 61, 62 when the wipers 63, 64 wipe the ink ejection faces 4. As the cap level adjusting mechanism 99 moves down the caps 61, 62, distal ends of the wipers 63, 64 come higher than the caps 61, 62, and the caps 61, 62 no longer come into contact with the ink ejection faces 4 during a wiping operation.

As shown in FIG. 1, each of the wipers 63 and 64 is disposed between a corresponding ink-jet head 2 and a cap 61, 62 associated with this ink-jet head 2. The wipers 63, 64 are made of an elastic material such as rubber. The wipers 63, 64 stand on later-described support plates 71, 72 which support the caps 61, 62 via the springs 67. In a case where the caps 61, 62 are not moved down by the cap level adjusting mechanism 99, the distal ends of the wipers 63, 64 are substantially at the same level as the base materials of the caps 61, 62.

Each of the four wipers 63 for the head group 3*a* extends up to a length substantially equal to a width with respect to the sub scanning direction of the ink ejection face 4 in the head group 3*a*. The four wipers 63 are separated from each other with respect to the sub scanning direction. Like the four wipers 63, each of the four wipers 64 for the head group 3*b* also extends up to a length substantially equal to a width of the ink ejection face 4 in the head group 3*b*. The four wipers 64 are separated from each other with respect to the sub scanning direction. As a result, even though the ink-jet heads 2 belonging to the head groups 3*a* and 3*b* eject ink of different colors, it can be prevented that, when the ink ejection faces 4 are wiped, ink collected by the wipers 63, 64 transfers to other ink ejection faces 4 adjacent thereto to cause ink colors to be mixed on the ink ejection faces 4.

As shown in FIGS. 1 and 2, the movement mechanism 70 has two support plates 71 and 72, one belt 73, and a pair of belt rollers 74 and 75. The two support plates 71 and 72 support the four caps 61 and the four caps 62, respectively. The one belt 73 is coupled with inner end portions of the respective support plates 71 and 72 with respect to the sub scanning direction. The pair of belt rollers 74 and 75 are disposed on outer sides of the head groups 3*a* and 3*b* with respect to the main scanning direction. The belt 73 spans the pair of belt rollers 74 and 75.

The support plate 71 supports the four caps 61 and the four wipers 63 associated with the four ink-jet heads 2 belonging to the head group 3*a*. At this time, the four caps 61 are located in the same position with respect to the main scanning direction, and the four wipers 63 are located in the same position with respect to the main scanning direction. The cap 61 and the wiper 63 are positioned in such a manner that, in a plan view, they overlap the corresponding ink-jet head 2 along the main scanning direction and also overlap the ink-jet head 2 belonging to the head group 3*b* along the sub scanning direction.

The support plate 72 supports the four caps 62 and the four wipers 64 associated with the four ink-jet heads 2 belonging to the head group 3*b*. At this time, the four caps 62 are located in the same position with respect to the main scanning direction, and the four wipers 64 are located in the same position with respect to the main scanning direction. The cap 62 and the wiper 64 are positioned in such a manner that, in a plan view, they overlap the corresponding ink-jet head 2 along the main scanning direction and also overlap the ink-jet head 2 belonging to the head group 3*a* along the sub scanning direction.

The pair of belt rollers 74 and 75 are rotatably supported on the tray 69 so as to position the belt 73 between the two head groups 3*a* and 3*b* within the tray 69. As shown in FIG. 2, the pair of belt rollers 74 and 75 are disposed in such a manner that their diameter direction includes the vertical direction. The pair of belt rollers 74 and 75 are supported so as to be rotatable in clockwise and counterclockwise directions in FIG. 2. The belt 73 is disposed such that its portions extending in the main scanning direction are opposed to each other with respect to the vertical direction. This enables a space formed between the head groups 3*a* and 3*b* to be made small even when the belt 73 is disposed between the head groups 3*a* and 3*b*. In addition, a length of the belt can be made relatively short, which can improve accuracy in conveyance of the caps 61 and 62.

The belt 73 of this embodiment is a rubber-made flat belt having a very narrow width. However, a rubber belt having a circular section, or a metal-made wire may be adopted for the belt 73. In short, any member may be adopted as long as it functions as a belt.

The support plate 71 is coupled with vertically-upper one of the portions of the belt 73 extending in the main scanning direction. The support plate 72 is coupled with vertically-lower one of the portions of the belt 73 extending in the main scanning direction. As shown in FIG. 1, four guide rails 68*c* extending in the main scanning direction are formed on the tray 69. Each of the pass throughs 68*a* and 68*b* is sandwiched between the guide rails 68*c* with respect to the sub scanning direction. Among the four guide rails 68*c*, upper two guide rails 68*c* shown in FIG. 1 are opposed to both ends of the support plates 71 with respect to the sub scanning direction. The two guide rails 68*c* are fitted with recesses which are formed at the both ends of the support plates 71 so as to extend in the main scanning direction. Thereby, the two guide rails 68*c* are slidable along the recesses. The lower two guide rails 68*c* shown in FIG. 1 are opposed to both ends of the support plates 72 with respect to the sub scanning direction. The two guide rails 68*c* are fitted with recesses which are formed at the both ends of the support plates 72 so as to extend in the main scanning direction. Thereby, the two guide rails 68*c* are slidable along the recesses.

With the maintenance unit 60 having the above-described structure, when a rotation motor 95 (see FIG. 4) rotates the belt roller 74 in the counterclockwise direction in FIG. 2, the four caps 61 and the four wipers 63 mounted on the support plate 71 are moved together with the support plate 71, leftward in FIG. 1 from a withdrawal position (as shown in FIG. 1) which is not opposed to the corresponding ink ejection faces 4, while the four caps 62 and the four wipers 64 mounted on the support plate 72 are moved together with the support plate 72, rightward in FIG. 1 from a withdrawal position (as shown in FIG. 1) which is not opposed to the corresponding ink ejection faces 4. Thus, all the caps 61, 62, and all the wipers 63, 64 can be moved to a position (maintenance position) opposed to the ink ejection faces 4.

At this time, each of the wipers 63, 64 moves from an inner end portion of the ink ejection face 4 of the corresponding ink-jet head 2 with respect to the main scanning direction (which inner end portion is near one end of the outside region 4*c*) toward an outer end portion thereof with respect to the main scanning direction, and stops at the outer end portion of the ink ejection face 4 (which outer end portion is near the other end of the outside region 4*c*). As shown in FIG. 3, in a case where a width of a paper, as exemplified by a paper P1, with respect to the main scanning direction is smaller than a width of the belt 8 with respect to the main scanning direction, the outer end portion of the ink ejection face 4 at which the wiper 63, 64 stops is in a position which overlaps an outside region of the belt 8 with respect to the vertical direction. In a case where a width of a paper, as exemplified by a paper P2, with respect to the main scanning direction is larger than a width of the belt 8 with respect to the main scanning direction, the outer end portion of the ink ejection face 4 at which the wiper 63, 64 stops is in a position which overlaps, with respect to the vertical direction, an outside region of a conveyance region where the paper is conveyed (i.e., a region outside the width of the paper P2 with respect to the main scanning direction). This can suppress contamination of the paper and the paper conveyance mechanism 10, and more particularly the belt 8, even when ink drops from an ink pool which is formed of ink collected by the wipers 63 and 64.

On the other hand, when the rotation motor 95 rotates the belt roller 74 in the clockwise direction in FIG. 2, the four caps 61 and the four wipers 63 mounted on the support plate 71 are moved together with the support plate 71, rightward in FIG. 1 from the maintenance position which is opposed to the corresponding ink ejection faces 4, while the four caps 62 and the four wipers 64 mounted on the support plate 72 are moved together with the support plate 72, leftward in FIG. 1 from the maintenance position which is opposed to the corresponding ink ejection faces 4. Thus, all the caps 61, 62, and all the wipers 63, 64 can be moved to the withdrawal position not opposed to the ink ejection faces 4.

Figure 4:
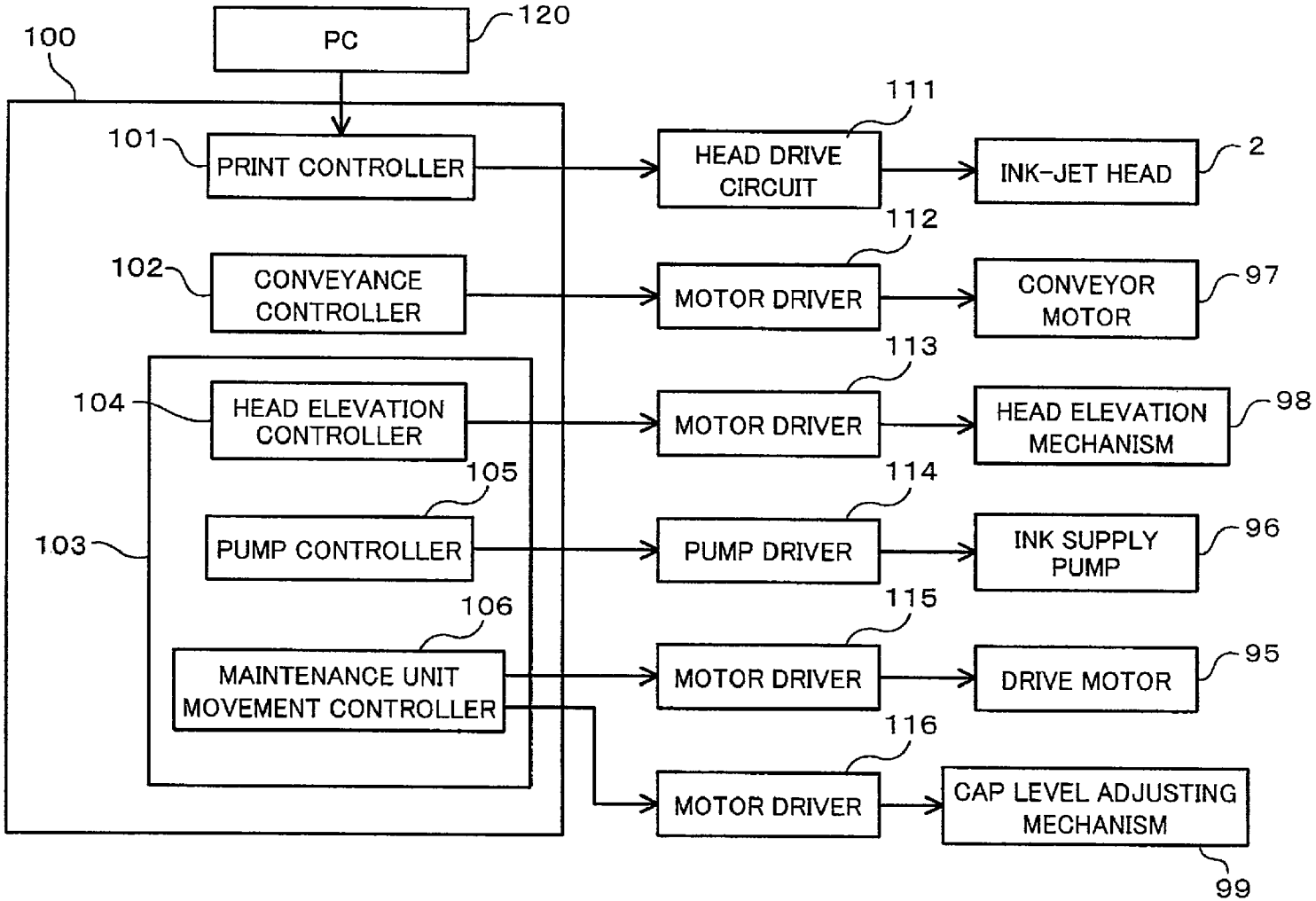
FIG. 4 is a block diagram schematically showing a controller.

Next, a controller 100 which controls an operation of the ink-jet printer 1 will be described with reference to FIG. 4. FIG. 4 is a block diagram schematically showing a controller. The controller 100 is made up of a CPU (Central Processing Unit), a ROM (Read Only Memory), a RAM (Random Access Memory), and the like, which work as a print controller 101, a conveyance controller 102, and a maintenance controller 103 as shown in FIG. 4.

When the controller 100 receives print data from an external device such as a PC (personal computer) 120, the print controller 101 controls a head drive circuit 111 to eject ink from the corresponding ink-jet head 2.

When the controller 100 receives print data from an external device such as the PC 120, the conveyance controller 102 controls a motor driver 112 so as to drive a conveyor motor 97 thereby conveying a paper on the conveyor belt 8.

The maintenance controller 103 has a head elevation controller 104, a pump controller 105, and a maintenance unit movement controller 106.

The head elevation controller 104 controls the head elevation mechanism 98 in accordance with a maintenance operation, to move up and down the ink-jet head 2 together with the elevation frame.

When a purge is needed, such as when ink is initially introduced into the ink-jet heads 2 or when printing is started after a rest condition where a printing operation is kept unperformed for a long time, the pump controller 105 controls a pump driver 114 so as to drive an ink supply pump 96 to forcibly feed ink into the ink-jet heads 2.

The maintenance unit movement controller 106, which is a part of the movement means, controls a motor driver 115 to thereby drive the drive motor 95, so as to make the belt 73 travel in a predetermined direction in accordance with a maintenance operation so that the caps 61, 62 and the wipers 63, 64 move together with the support plates 71, 72. Moreover, the maintenance controller 106 controls a motor driver 116 in such a manner that the cap level adjusting mechanism 99 moves down the caps 61, 62 to a lower level, in order that the wipers 63, 64 can wipe the ink ejection faces 4. The motor drivers 115 and 116, the drive motor 95, and the cap level adjusting mechanism 99 also form a part of the movement means.

Figures 5A, 5B, 5C:
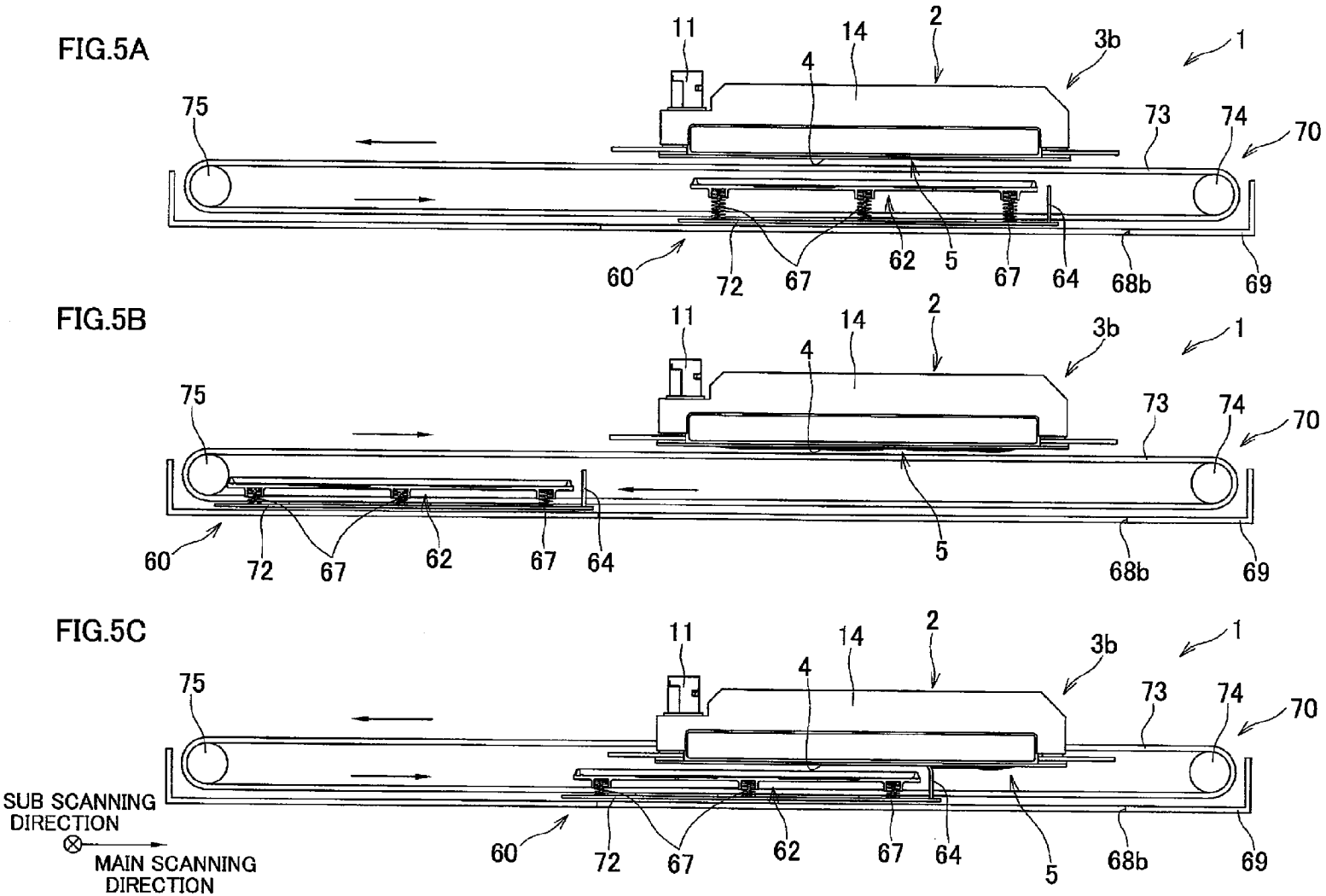
FIGS. 5A, 5B, and 5C show, over time, a purge operation on ink-jet heads and a wiping operation on ink ejection faces.
Figures 6A, 6B, 6C:
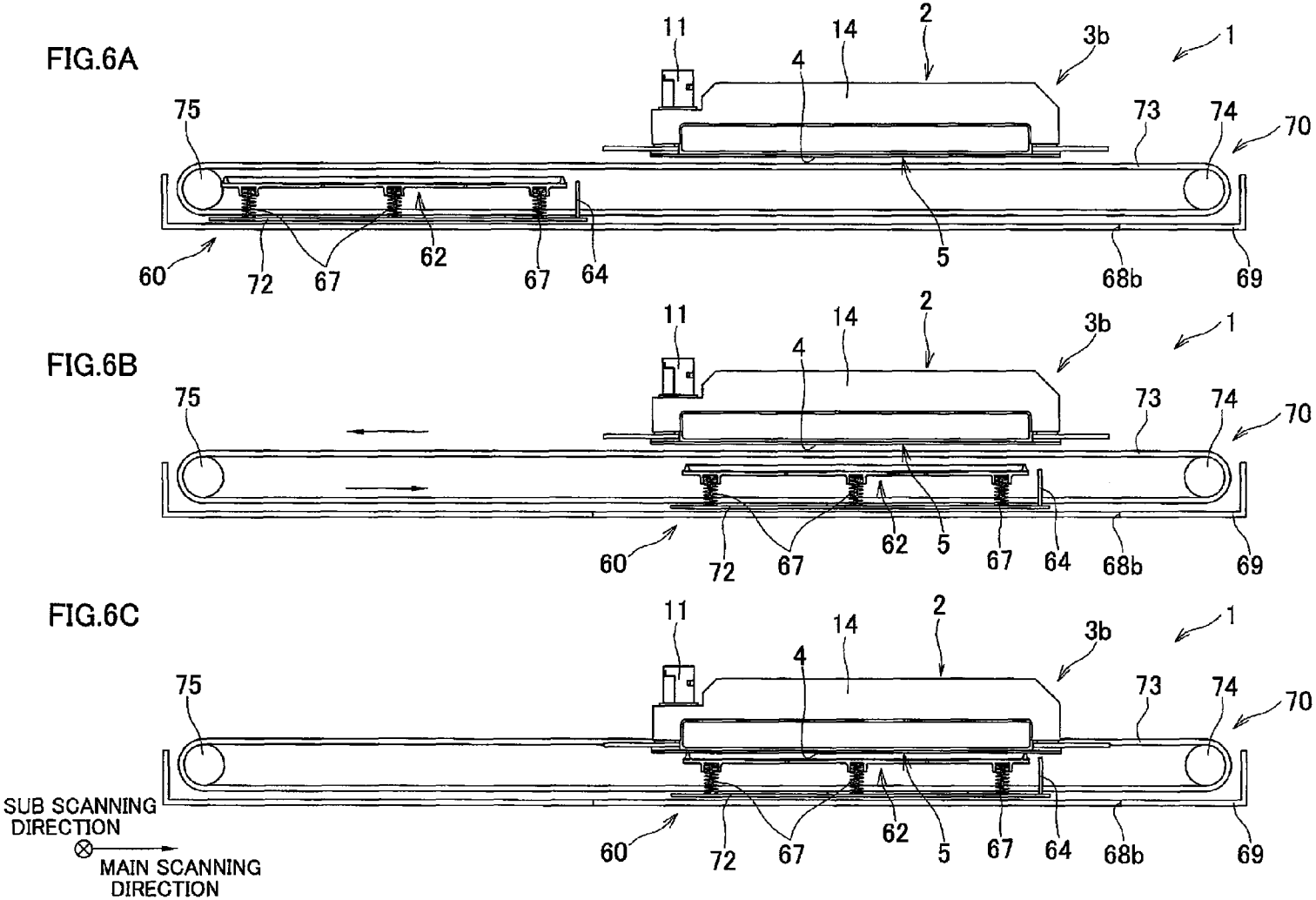
FIGS. 6A, 6B, and 6C show, over time, a capping operation for covering the ink ejection faces with caps.

Next, a maintenance operation performed by the maintenance unit 60 will be described with reference to FIGS. 5A to 5C and FIGS. 6A to 6C. FIGS. 5A, 5B, and 5C show, over time, a purge operation on ink-jet heads and a wiping operation on ink ejection faces. FIGS. 6A, 6B, and 6C show, over time, a capping operation for covering the ink ejection faces with caps.

For performing a purge operation in order to restore the ink-jet head 2 which is showing ejection failure or the like, the head elevation controller 104 controls the head elevation mechanism 98 so that all of the ink-jet heads 2 belonging to the two head groups 3*a* and 3*b* are moved up from the printing position to the head maintenance position, as shown in FIG. 5A. Then, the maintenance unit movement controller 106 controls the drive motor 95 so as to rotate the belt roller 74 in the counterclockwise direction in FIG. 4 and thereby make the belt 73 travel along the main scanning direction, so that all of the caps 61 and 62 move from the withdrawal position to the maintenance position.

At this time, the caps 61 associated with the head group 3*a* move leftward in FIG. 1 along the main scanning direction, and the caps 62 associated with the head group 3*b* move rightward in FIG. 1 (rightward in FIG. 4) along the main scanning direction. In other words, the cap 61 and the cap 62 move in opposite directions with respect to the main scanning direction. At this time, the wipers 63, 64 mounted on the same support plates 71, 72 also move together with the caps 61, 62, respectively.

Then, the pump controller 105 supplies ink from a supply pump 96 to the ink-jet heads 2, to thereby perform a purge operation for ejecting ink from the nozzles 4*a* of the ink-jet heads 2 toward the caps 61, 62. After ink is purged into the caps 61, 62, the maintenance unit movement controller 106 controls the drive motor 95 so as to rotate the belt roller 74 in the clockwise direction in FIG. 4 and thereby make the belt 73 travel along the main scanning direction, so that all of the caps 61 and 62 move from the maintenance position to the withdrawal position.

At this time, the cap 61 associated with the head group 3*a* moves rightward in FIG. 1 along the main scanning direction, and the cap 62 associated with the head group 3*b* moves leftward in FIG. 1 (leftward in FIG. 5A) along the main scanning direction. Then, the motor driver 116 controls the cap level adjusting mechanism 99 to move down all of the caps 61, 62, as shown in FIG. 5B. At this time, the caps 61, 62 are moved down to such a degree that the distal ends (upper ends) of the wipers 63, 64 come higher than upper ends of the caps 61, 62 are.

Then, the head elevation controller 104 controls the head elevation mechanism 98 to move down all of the ink-jet heads 2 to such a degree that the ink ejection faces 4 come slightly lower than the distal ends of the wipers 63, 64 and higher than the upper ends of the caps 61, 62, as shown in FIG. 5C. Then, the maintenance unit movement controller 106 controls the drive motor 95 so as to rotate the belt roller 74 in the counterclockwise direction in FIG. 4 and thereby make the belt 73 travel along the main scanning direction, so that all of the wipers 63 and 64 move from the withdrawal position to a position which allows the caps 61 and 62 to reach the maintenance position.

At this time, the distal ends of the wipers 63 and 64, which locate higher than the ink ejection faces 4, come into contact with the ink ejection faces 4 while bending, so that ink adhering to the ink ejection faces 4 as a result of the purge is wiped off. At this time, in addition, while being in contact with the ink ejection face 4 to be wiped, the wiper 63, 64 moves from an inner end portion of the ink ejection face 4 to be wiped (one end of the outside region 4*c*) toward an outer end portion thereof with respect to the main scanning direction. At a position where the wiper 63, 64 reaches the outer end portion of the ink ejection face 4 (the other end of the outside region 4*c*), the wiper 63, 64 stops its wiping operation. Since the wiping operation is ended at a time when the wiper 63, 64 reaches the outer end portion of the ink ejection face 4, the wiper 63, 64 moving from the inner end portion of the ink ejection face 4 in the main scanning direction does not go beyond the outer end portion of the ink ejection face 4 during the wiping operation. This can suppress splashing of collected ink which is caused when the wipers 63 and 64 move in the main scanning direction beyond the outer end portion of the ink ejection face 4.

Then, the head elevation controller 104 controls the head elevation mechanism 98 to move up all of the ink-jet heads 2 so as to separate the wipers 63 and 64 from the ink ejection faces 4. Then, all of the wipers 63 and 64 are moved to the withdrawal position. In this way, the maintenance operation is completed in which the ink-jet head 2 showing ink ejection failure is restored by the purge and ink adhering to the ink ejection face 4 as a result of the purge is wiped off.

In the following, a description will be given to a capping operation for covering the ink ejection face 4 with the cap 61, 62 during a rest time in which the printer 1 does not perform printing on a paper or the like for a long time. In this case as well as in the above-described case, the head elevation controller 104 controls the head elevation mechanism 98 to move up all of the ink-jet heads 2 belonging to the two head groups 3*a* and 3*b* from the printing position to the head maintenance position (see FIG. 6A). Then, the maintenance unit movement controller 106 controls the drive motor 95 so as to rotate the belt roller 74 in the counterclockwise direction in FIG. 6A and thereby make the portions of the belt 73 extending in the main scanning direction travel along the main scanning direction, so that all of the caps 61 and 62 move from the withdrawal position to the maintenance position, as shown in FIG. 6B.

Then, the head elevation controller 104 controls the head elevation mechanism 98 to move down all of the ink-jet heads 2 to such a degree that the ink ejection faces 4 come into contact with the upper ends of the caps 61, 62, as shown in FIG. 6C. In this way, an enclosed space is formed between the ink ejection face 4 and the cap 61, 62, which can prevent ink existing within the nozzles 4*a* from drying up.

In the above-described ink-jet printer 1 of this embodiment, the eight ink-jet heads 2 are arranged in such a manner that the ink ejection faces 4 of the eight ink-jet heads 2 form two rows each including four ink ejection faces 4 which are arranged side by side along the sub scanning direction and in addition the ink ejection faces 4 included in different rows do not overlap each other with respect to the main scanning direction. When wiping the ink ejection faces 4, the two wipers 63, 64 for the two ink ejection faces 4 included in different rows move along the main scanning direction from the inner end portions of the ink ejection faces 4 to positions at which the wipers 63, 64 overlap, with respect to the vertical direction, the outside region of the conveyance region where the paper is conveyed by the paper conveyance mechanism 10 and the outside region of the paper conveyance mechanism 10. As a result, contamination of the paper and the paper conveyance mechanism 10, and more particularly the belt 8 can be suppressed, even when ink drops from the ink pool which is formed of ink collected by the wipers 63 and 64.

When the eight wipers 63 and 64 are located in the withdrawal position not opposed to the ink ejection faces 4, the wiper 63 associated with the ink-jet head 2 included in one row is located in a position overlapping the ink-jet head 2 included in the one row with respect to the main scanning direction and also overlapping the ink-jet head 2 included in the other row with respect to the sub scanning direction, while the wiper 64 associated with the ink-jet head 2 included in the other row is located in a position overlapping the ink-jet head 2 included in the other row with respect to the main scanning direction and also overlapping the ink-jet head 2 included in the one row with respect to the sub scanning direction. As a result, even though free spaces are formed in regions neighboring the eight ink-jet heads 2 with respect to the main scanning direction, the eight wipers 63, 64 associated with the respective ink-jet heads 2 are positioned in these spaces. Positioning the wipers 63, 64 in the free spaces in this way makes it unnecessary to provide another space which is special for the eight wipers 63, 64 to be positioned therein. Therefore, the ink-jet printer 1 can be downsized.

Moreover, the eight ink-jet heads 2 are divided into two head groups 3*a* and 3*b* which correspond to different rows. Each of the two head groups 3*a* and 3*b* is made up of four ink-jet heads 2 which are located in the same position with respect to the main scanning direction and whose ink ejection faces 4 are adjacent to each other. Accordingly, even though free spaces are formed in regions neighboring the two head groups 3*a* and 3*b* with respect to the main scanning direction, the eight wipers 63, 64 associated with the ink-jet heads 2 belonging to the respective head groups are positioned in these spaces. Therefore, the ink-jet printer 1 can be downsized.

In addition, there are the pair of belt rollers 74 and 75, and the belt 73 which spans the pair of belt rollers 74 and 75 and is coupled with all of the wipers 63 and 64 so that as the belt 73 travels the wipers 63 and 64 can be moved from the withdrawal position along the main scanning direction. Therefore, as the drive motor 95 which is a single drive source is used to make the belt 73 travel, all of the ink ejection faces 4 can be wiped by the wipers 63 and 64.

Figure 7:
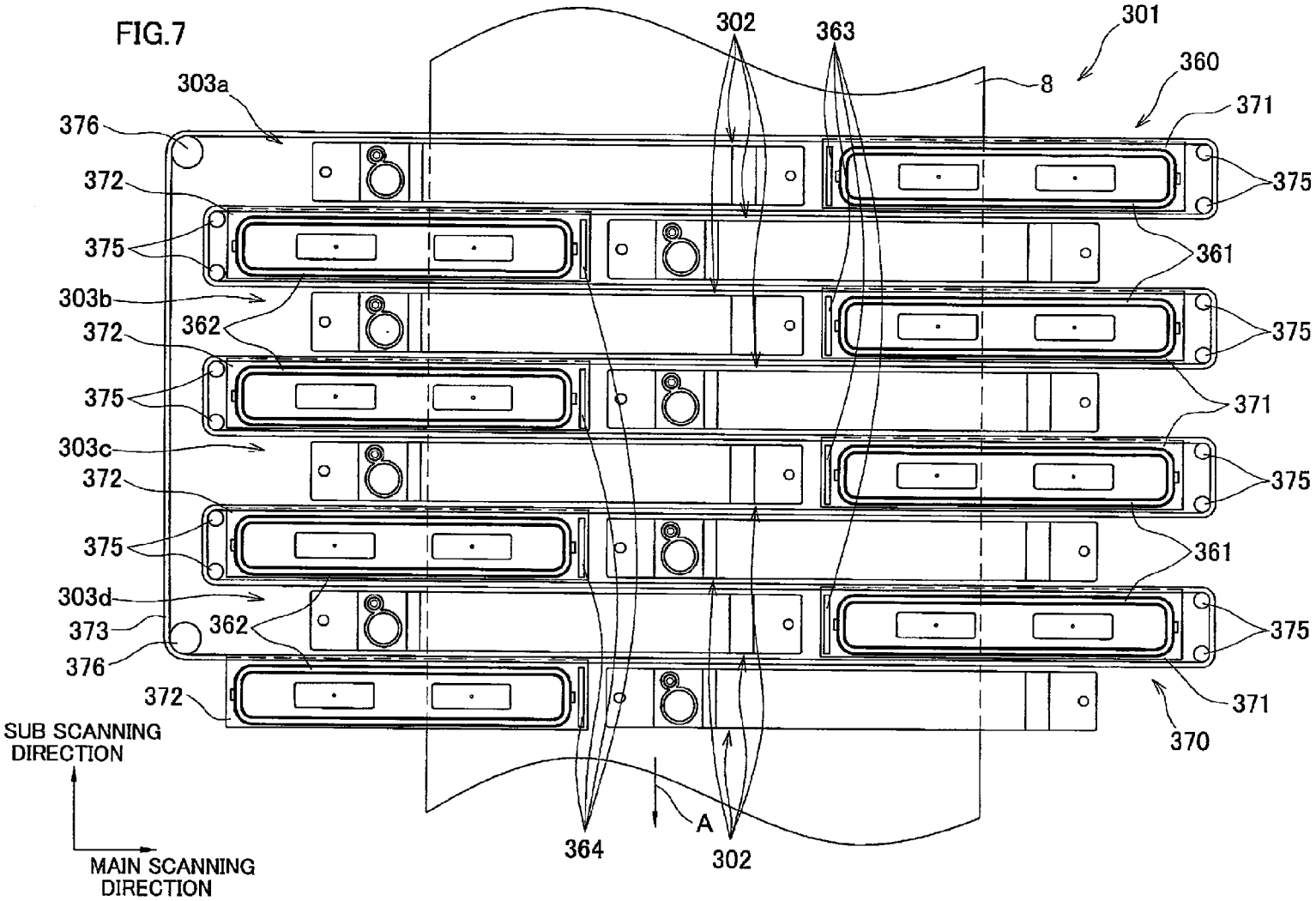
FIG. 7 is a plan view of an essential part of an ink-jet printer according to a second embodiment of the present invention.

Next, an ink-jet printer 301 according to a second embodiment of the present invention will be described below with reference to FIG. 7. FIG. 7 is a plan view of an essential part of an ink-jet printer according to a second embodiment of the present invention.

The ink-jet printer 301 which is an image recording apparatus of this embodiment differs from that of the first embodiment, in that arrangement of eight ink-jet heads 302 which are liquid ejection heads is different from the arrangement of the eight ink-jet heads 2 of the first embodiment. Accordingly, arrangements of the eight caps 361 and 362 and eight wipers 363 and 364 are also different from the arrangements of the eight caps 61 and 62 and the eight wipers 63 and 64 of the first embodiment. In addition, a maintenance unit 360 of the ink-jet printer 301 has a movement mechanism 370 which is different in structure from the movement mechanism 70 of the first embodiment. In other points, the second embodiment is the same as the first embodiment. Structures of the ink-jet heads 302, the caps 361 and 362, and the wipers 363 and 364 are the same as in the first embodiment. Only an arrangement pattern thereof is different from in the first embodiment. The same members as of the first embodiment will be denoted by the same reference signs without specific descriptions thereof.

As shown in FIG. 7, the eight ink-jet heads 302 of this embodiment are arranged in such a manner that the ink ejection faces 4 form two rows each including four ink ejection faces 4 which are arranged side by side along the sub scanning direction and in addition the ink ejection faces included in different rows do not overlap each other with respect to the main scanning direction. The eight ink-jet heads 302 are divided into four head groups 303*a*, 303*b*, 303*c*, and 303*d* each of which includes two ink-jet heads 302. Ink ejection faces 4 of the two ink-jet heads 302 are adjacent to each other with respect to the sub scanning direction and belong to different rows. The four head groups 303*a*, 303*b*, 303*c*, and 303*d* are arranged side by side along the sub scanning direction, so as to arrange the eight ink-jet heads 302 in a zigzag pattern with respect to the sub scanning direction.

Two ink-jet heads 302 included in each of the head groups 303*a*, 303*b*, 303*c*, and 303*d* have their ink ejection faces 4 overlap each other in the sub scanning direction, so that a print region for making printing on a paper continue in the main scanning direction. More specifically, the ink-jet heads 302 are arranged in such a manner that an interval in the main scanning direction between neighboring nozzles 4*a* in an ink ejection region of one ink-jet head 302 is the same as an interval in the main scanning direction between an innermost (i.e., leftmost in FIG. 7) one of the nozzles 4*a* formed in the ink ejection face 4 of the right-side ink-jet head 302 in FIG. 7 which is included in the head group 303*a* and an innermost (i.e., rightmost in FIG. 7) one of the nozzles 4*a* formed in the ink ejection face 4 of the left-side ink-jet head 302 in FIG. 7 which is included in the head group 303*a*. Each of the other head groups 303*b*, 303*c*, and 303*d* includes two ink-jet heads 302 arranged in the same manner as in the head group 303*a*.

The four head groups 303*a*, 303*b*, 303*c*, and 303*d* eject ink of different colors. In this embodiment, the two ink-jet heads 302 belonging to the head group 303*a* eject magenta ink, the two ink-jet heads 302 belonging to the head group 303*a* eject magenta ink, the two ink-jet heads 302 belonging to the head group 303*c* eject cyan ink, and the two ink-jet heads 302 belonging to the head group 303*d* eject black ink.

The maintenance unit 360 has eight caps 361 and 362, eight wipers 363 and 364, and a movement mechanism 370. The eight caps 361 and 362, and the eight wipers 363 and 364 correspond to the eight ink-jet heads 302, respectively. The movement mechanism 370 moves the respective caps 361, 362 and the respective wipers 363, 364 in the main scanning direction.

The movement mechanism 370 has fourteen rollers 375, two rollers 376, one belt 373, four support plates 371, and four support plates 372. Each of the two rollers 376 has a diameter slightly larger than the roller 375. The one belt 373 spans the sixteen rollers 375 and 376. Each of the four support plates 371 is, at its one end (upper end in FIG. 7) with respect to the sub scanning direction, coupled with the belt 373, and each support plate 371 supports the cap 361 and the wiper 363 associated with the ink-jet head 302 belonging to one (left one in FIG. 7) of the rows. Each of the four support plates 372 is, at its one end (upper end in FIG. 7) with respect to the sub scanning direction, coupled with the belt 373, and each support plate 372 supports the cap 362 and the wiper 364 associated with the ink-jet head 302 belonging to the other (right one in FIG. 7) of the rows.

The four support plates 371 are positioned so as to overlap the ink-jet heads 302 belonging to the left row in FIG. 7 along the main scanning direction, and in addition so as to overlap the ink-jet heads 302 belonging to the right row in FIG. 7 along the sub scanning direction. Thus, the caps 361 and the wipers 363 supported on the support plates 371 are arranged in the same manner.

The four support plates 372 are positioned so as to overlap the ink-jet heads 302 belonging to the right row in FIG. 7 along the main scanning direction, and in addition so as to overlap the ink-jet heads 302 belonging to the left row in FIG. 7 along the sub scanning direction. Thus, the caps 362 and the wipers 364 supported on the support plates 372 are arranged in the same manner.

In other words, the eight support plates 371 and 372 are arranged in a zigzag pattern inverse to the zigzag arrangement pattern of the eight ink-jet heads 302, with respect to the sub scanning direction. Such a zigzag arrangement of the support plates 371, 372, the caps 361, 362, and the wipers 363, 364 inverse to the zigzag arrangement of the ink-jet heads 302 contributes to downsizing of the ink-jet printer 301.

The fourteen rollers 375 are arranged in such a manner that they neighbor outer end portion corners, with respect to the main scanning direction, of the seven support plates 371 and 372 other than the lowermost support plate 372 in FIG. 7, and in addition the belt 373 which spans the fourteen rollers 375 is, in its portions extending in the main scanning direction, disposed in parallel with each other between neighboring ink-jet heads 302. The two rollers 376 are arranged in such a manner that the portions of the belt 373 extending in the main scanning direction and spanning the two rollers 376 and the two of the rollers 375 located outermost with respect to the sub scanning direction are disposed in parallel with each other, in a position outside the upper head group 303*a* with respect to the sub scanning direction in FIG. 7 and in a position between two ink-jet heads 302 belonging to the lowermost head group 303*d* with respect to the sub scanning direction in FIG. 7.

Since the rollers 375 and 376, and the belt 373 are arranged like this, all of the caps 361 and 362 and all of the wipers 363 and 364 can be moved from the withdrawal position not opposed to the ink ejection faces 4 to the position (maintenance position) opposed to the ink ejection faces 4, simply by making the belt 373 travel, even though the eight ink-jet heads 302 are arranged in a zigzag pattern.

With the maintenance unit 360 having the above-described structure, when the drive motor 95 rotates one (upper left one in FIG. 7) roller 376 in the counterclockwise direction in FIG. 7, the caps 361 and the wipers 363 mounted on the respective support plate 371 move together with the support plates 371 from the withdrawal position (as shown in FIG. 7), leftward in FIG. 7 along the main scanning direction, while the caps 362 and the wipers 364 mounted on the respective support plate 372 move together with the support plates 372 from the withdrawal position, rightward in FIG. 7 along the main scanning direction. Thus, all the caps 361, 362, and all the wipers 363, 364 can be moved to a position (maintenance position) opposed to the ink ejection faces 4.

At this time, each of the wipers 363, 364 moves from an inner end portion of the ink ejection face 4 of the corresponding ink-jet head 302 with respect to the main scanning direction (one end of the outside region 4*c*) toward an outer end portion thereof with respect to the main scanning direction, and stops at the outer end portion of the ink ejection face 4 (the other end of the outside region 4*c*). Like in the first embodiment, in a case where a width of a paper with respect to the main scanning direction is smaller than a width of the belt 8 with respect to the main scanning direction, the outer end portion of the ink ejection face 4 at which the wiper 363, 364 stops is in a position which overlaps an outside region of the belt 8 with respect to the vertical direction. In a case where a width of a paper with respect to the main scanning direction is larger than a width of the belt 8 with respect to the main scanning direction, the outer end portion of the ink ejection face 4 at which the wiper 363, 364 stops is in a position which overlaps, with respect to the vertical direction, an outside region of a conveyance region where the paper is conveyed (i.e., a region outside the width of the paper with respect to the main scanning direction). This can suppress contamination of the paper and the paper conveyance mechanism 10, and more particularly the belt 8, even when ink drops from an ink pool which is formed of ink collected by the wipers 363 and 364.

On the other hand, when the drive motor 95 rotates one roller 376 in the clockwise direction in FIG. 7, the caps 361 and the wipers 363 move together with the respective support plates 371 from the position opposed to the ink ejection faces 4, rightward in FIG. 7 along the main scanning direction, while the caps 362 and the wipers 364 move together with the respective support plates 372 from the maintenance position opposed to the ink ejection faces 4, leftward in FIG. 7 along the main scanning direction. Thus, all the caps 361, 362, and all the wipers 363, 364 can be moved to the withdrawal position not opposed to the ink ejection faces 4.

In this embodiment, like this, the caps 361, 362 and the wipers 363, 364 associated with two ink-jet heads 302 belonging to each of the head groups 303*a*, 303*b*, 303*c*, and 303*d* are movable in opposite directions with respect to the main scanning direction. Therefore, the same maintenance operation as in the first embodiment can be performed by the maintenance unit 360 of this embodiment.

In the ink-jet printer 301 of this embodiment, the eight ink-jet heads 302 are arranged in such a manner that the ink ejection faces 4 of the eight ink-jet heads 302 form two rows each including four ink ejection faces 4 which are arranged side by side along the sub scanning direction and in addition the ink ejection faces 4 included in different rows do not overlap each other with respect to the main scanning direction. However, when wiping the ink ejection faces 4, two wipers 363 and 364 associated with two ink ejection faces 4 belonging to different rows move along the main scanning direction from the inner end portions of the ink ejection faces 4 to positions at which the wipers 363, 364 overlap, with respect to the vertical direction, the outside region of the paper conveyance region of the paper conveyance mechanism 10 and the outside region of the paper conveyance mechanism 10. This can suppress contamination of the paper and the paper conveyance mechanism 10, and more particularly the belt 8, even when ink drops from an ink pool which is formed of ink collected by the wipers 363 and 364.

Moreover, even though free spaces are formed in regions neighboring the ink-jet heads 302 belonging to the respective head groups 303*a*, 303*b*, 303*c*, and 303*d* with respect to the main scanning direction, the eight caps 361, 362 and the eight wipers 363, 364 are positioned in these spaces. Therefore, the ink-jet printer 301 can be downsized.

Figure 8:
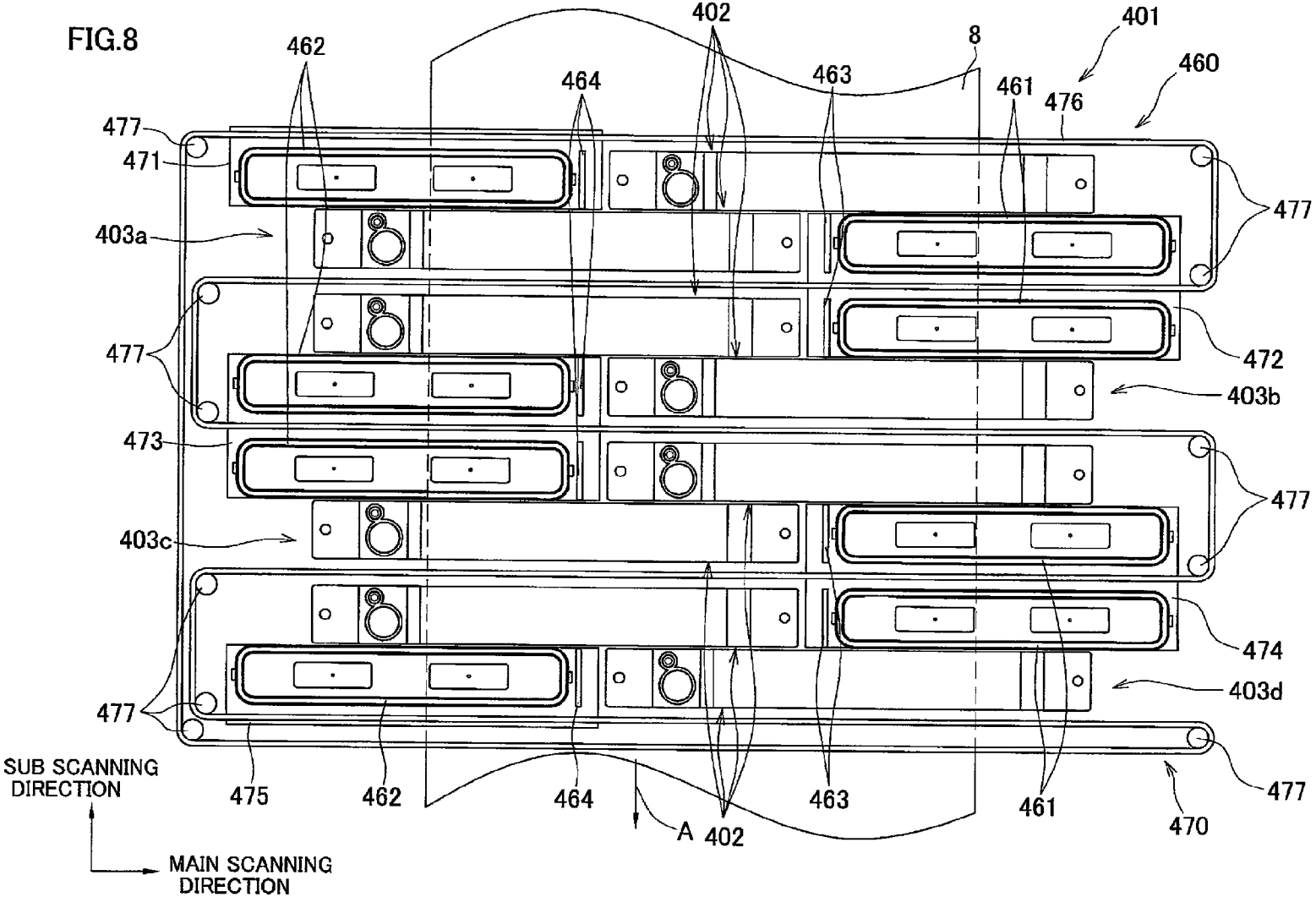
FIG. 8 is a plan view of an essential part of an ink-jet printer according to a third embodiment of the present invention.

Next, an ink-jet printer 401 according to a third embodiment of the present invention will be described below with reference to FIG. 8. FIG. 8 is a plan view of an essential part of an ink-jet printer according to a third embodiment of the present invention.

In the ink-jet printer 401 of this embodiment, neighboring ones of head groups 403*a*, 403*b*, 403*c*, and 403*d* with respect to the sub scanning direction are oriented in opposite directions, which is different from the arrangement of the head groups 303*a*, 303*b*, 303*c*, and 303*d* of the second embodiment. Accordingly, arrangement of eight caps 461, 62 and eight wipers 463, 64 is also different from the arrangement of the eight caps 361, 362 and the eight wipers 363, 364 of the second embodiment. In addition, a maintenance unit 460 of the ink-jet printer 401 has a movement mechanism 470 which is slightly different from the movement mechanism 370 of the second embodiment. Except for the above, the third embodiment is the same as the second embodiment. Structures of ink-jet heads 402, caps 461, 462, and wipers 463, 464 are the same as in the second embodiment, but only arrangements thereof are different from in the second embodiment. The same members as of the second embodiment will be denoted by the same reference signs without specific descriptions thereof.

As shown in FIG. 8, the eight ink-jet heads 402 of this embodiment are arranged in such a manner that the ink ejection faces 4 form two rows each including four ink ejection faces 4 which are arranged side by side along the sub scanning direction and in addition the ink ejection faces included in different rows do not overlap each other with respect to the main scanning direction. The eight ink-jet heads 402 are divided into four head groups 403*a*, 403*b*, 403*c*, and 403*d* each of which includes two ink-jet heads 402. Ink ejection faces 4 of the two ink-jet heads 402 are adjacent each other with respect to the sub scanning direction and belong to different rows.

The four head groups 403*a*, 403*b*, 403*c*, and 403*d* are arranged side by side along the sub scanning direction. One (left one in FIG. 8) of the two ink-jet heads 402 in the head group 403*a* and one of the two ink-jet heads 402 in the head group 403*b* are located in positions which are the same with respect to the main scanning direction and adjacent to each other with respect to the sub scanning direction. The other (right one in FIG. 8) of the two ink-jet heads 402 in the head group 403*b* and the other of the two ink-jet heads 402 in the head group 403*c* are located in positions which are the same with respect to the main scanning direction and adjacent to each other with respect to the sub scanning direction. One of the two ink-jet heads 402 in the head group 403*c* and one of the two ink-jet heads 402 in the head group 403*d* are located in positions which are the same with respect to the main scanning direction and adjacent to each other with respect to the sub scanning direction.

Consequently, two caps 461, 462 and two wipers 463, 464 associated with two adjacent ink-jet heads 402 which belong to neighboring two of the head groups 403*a*, 403*b*, 403*c*, and 403*d* can be disposed at positions which are the same with respect to the main scanning direction and adjacent to each other with respect to the sub scanning direction.

The two ink-jet heads 402 belonging to each of the head groups 403*a*, 403*b*, 403*c*, and 403*d* have their ink ejection faces 4 overlap each other with respect to the sub scanning direction, which is the same structure as that of the head groups 303*a*, 303*b*, 303*c*, and 303*d* of the second embodiment. The four head groups 403*a*, 403*b*, 403*c*, and 403*d* eject ink of different colors like in the second embodiment. Therefore, the same effect can be obtained.

The maintenance unit 460 has eight caps 461 and 462, eight wipers 463 and 464, and a movement mechanism 470. The eight caps 461 and 462, and the eight wipers 463 and 464 correspond to the eight ink-jet heads, respectively. The movement mechanism 470 moves the respective caps 461, 462 and the respective wipers 463, 464 in the main scanning direction.

The movement mechanism 470 has eleven rollers 477, one belt 476 which spans the rollers 477, and five support plates 471 to 475 coupled with the belt 476. The eleven rollers 477 are arranged in such a manner that portions of the belt 476 extending in the main scanning direction are disposed in parallel with each other, in positions between the respective head groups and in positions outside the four head groups 403*a*, 403*b*, 403*c*, and 403*d*, with respect to the sub scanning direction.

The support plate 471 is positioned so as to overlap, with respect to the main scanning direction, the other ink-jet head 402 (in the right row in FIG. 8) belonging to the head group 403*a*, and in addition so as to overlap, with respect to the sub scanning direction, one ink-jet head 402 (in the left row in FIG. 8) belonging to the head group 403*a*. The support plate 471 supports the cap 462 and the wiper 464 associated with the other ink-jet head 402 belonging to the head group 403*a*. The support plate 471 is coupled with the portion of the belt 476 extending in the main scanning direction.

The support plate 475 is positioned so as to overlap, with respect to the main scanning direction, the other ink-jet head 402 belonging to the head group 403*d*, and in addition so as to overlap, with respect to the sub scanning direction, one ink-jet head 402 belonging to the head group 403*d*. The support plate 475 supports the cap 462 and the wiper 464 associated with the other ink-jet head 402 belonging to the head group 403*d*. The support plate 475 is coupled with the portion of the belt 476 extending in the main scanning direction.

The support plate 472 is positioned so as to overlap, with respect to the main scanning direction, one ink-jet head 402 belonging to each of the head groups 403*a* and 403*b*, and in addition so as to overlap, with respect to the sub scanning direction, the other ink-jet head 402 belonging to each of the head groups 403*a* and 403*b*. The support plate 473 is positioned so as to overlap, with respect to the main scanning direction, the other ink-jet head 402 belonging to each of the head groups 403*b* and 403*c*, and in addition so as to overlap, with respect to the sub scanning direction, one ink-jet head 402 belonging to each of the head groups 403*b* and 403*c*. The support plate 474 is positioned so as to overlap, with respect to the main scanning direction, one ink-jet head 402 belonging to each of the head groups 403*c* and 403*d*, and in addition so as to overlap, with respect to the sub scanning direction, the other ink-jet head 402 belonging to each of the head groups 403*c* and 403*d*.

Each of the three support plates 472 to 474 supports two caps and two wipers associated with two ink-jet heads 402 which are, with respect to the sub scanning direction, sandwiched between other two ink-jet heads 402. The other two ink-jet heads 402 are outermost ones of the ink-jet heads 402 belonging to the neighboring two head groups. To be more specific, the support plate 472 supports two caps 461 and two wipers 463 each associated with the one (left one in FIG. 8) ink-jet head 402 belonging to each of the two head groups 403*a* and 403*b*. The support plate 473 supports two caps 462 and two wipers 464 each associated with the other ink-jet head 402 belonging to each of the two head groups 403*b* and 403*c*. The support plate 474 supports two caps 461 and two wipers 463 each associated with the one ink-jet head 402 belonging to each of the two head groups 403*c* and 403*d*.

In this way, it is possible to move the three support plates 472 to 474 each of which supports two caps 461 (or 462) and two wipers 463 (or 464) associated with two ink-jet heads 402. In addition, as compared with in the second embodiment, a less number of portions of the belt 476 extending in the main scanning direction are positioned between neighboring ink-jet heads 402, which can simplify the structure of the movement mechanism 470.

With the maintenance unit 460 having the above-described structure, when the drive motor 95 rotates one (upper left one in FIG. 8) roller 477 in the clockwise direction in FIG. 8, the four caps 461 and the four wipers 463 mounted on the two support plates 472 and 474 move together with the support plates 472 and 474 from the withdrawal position (as shown in FIG. 8), leftward in FIG. 8 along the main scanning direction, while the four caps 462 and the four wipers 464 mounted on the three support plates 471, 473, and 475 move together with the support plates 471, 473, and 475 from the withdrawal position, rightward in FIG. 8 along the main scanning direction. Thus, all the caps 461, 462, and all the wipers 463, 464 can be moved to a position (maintenance position) opposed to the ink ejection faces 4.

At this time, each of the wipers 463, 464 moves from an inner end portion of the ink ejection face 4 of the corresponding ink-jet head 402 with respect to the main scanning direction (one end of the outside region 4*c*) toward an outer end portion thereof with respect to the main scanning direction, and stops at the outer end portion of the ink ejection face 4 (the other end of the outside region 4*c*). Like in the first embodiment, in a case where a width of a paper with respect to the main scanning direction is smaller than a width of the belt 8 with respect to the main scanning direction, the outer end portion of the ink ejection face 4 at which the wiper 463, 464 stops is in a position which overlaps an outside region of the belt 8 with respect to the vertical direction. In a case where a width of a paper with respect to the main scanning direction is larger than a width of the belt 8 with respect to the main scanning direction, the outer end portion of the ink ejection face 4 at which the wiper 463, 464 stops is in a position which overlaps, with respect to the vertical direction, an outside region of a conveyance region where the paper is conveyed (i.e., a region outside the width of the paper with respect to the main scanning direction). This can suppress contamination of the paper and the paper conveyance mechanism 10, and more particularly the belt 8, even when ink drops from an ink pool which is formed of ink collected by the wipers 463 and 464.

On the other hand, when the drive motor 95 rotates one roller 477 in the counterclockwise direction in FIG. 8, the four caps 461 and the four wipers 463 move together with the two support plates 472 and 474 from the maintenance position opposed to the corresponding ink ejection faces 4, rightward in FIG. 8 along the main scanning direction, while the four caps 462 and the four wipers 464 move together with the three support plates 471, 473, and 475 from the maintenance position opposed to the corresponding ink ejection faces 4, leftward in FIG. 8 along the main scanning direction. Thus, all the caps 461, 462, and all the wipers 463, 464 can be moved to the withdrawal position not opposed to the ink ejection faces 4.

In this embodiment, like this, the caps 461, 462 and the wipers 463, 464 associated with two ink-jet heads 402 belonging to each of the head groups 403*a*, 403*b*, 403*c*, and 403*d* are movable in opposite directions with respect to the main scanning direction. Therefore, the same maintenance operation as in the first embodiment can be performed by the maintenance unit 460 of this embodiment.

In the ink-jet printer 401 of this embodiment, the eight ink-jet heads 402 are arranged in such a manner that the ink ejection faces 4 of the eight ink-jet heads 402 form two rows each including four ink ejection faces 4 which are arranged side by side along the sub scanning direction and in addition the ink ejection faces 4 included in different rows do not overlap each other with respect to the main scanning direction. When wiping the ink ejection faces 4, two wipers 463 and 464 associated with two ink ejection faces 4 belonging to different rows move along the main scanning direction from the inner end portions of the ink ejection faces 4 to positions at which the wipers 463, 464 overlap, with respect to the vertical direction, the outside region of the paper conveyance region of the paper conveyance mechanism 10 and the outside region of the paper conveyance mechanism 10. This can suppress contamination of the paper and the paper conveyance mechanism 10, and more particularly the belt 8, even when ink drops from an ink pool which is formed of ink collected by the wipers 463 and 464.

Moreover, even though free spaces are formed in regions neighboring the ink-jet heads 402 belonging to the respective head groups 403*a*, 403*b*, 403*c*, and 403*d* with respect to the main scanning direction, the eight caps 461, 462 and the eight wipers 463, 464 are positioned in these spaces. Therefore, the ink-jet printer 401 can be downsized. In addition, by making one belt 476 travel, all of the caps 461, 462, and all of the wipers 463, 464 can be moved from the withdrawal position to the maintenance position and from the maintenance position to the withdrawal position. Therefore, a structure of the movement mechanism 470 can be simplified.

Figure 9:
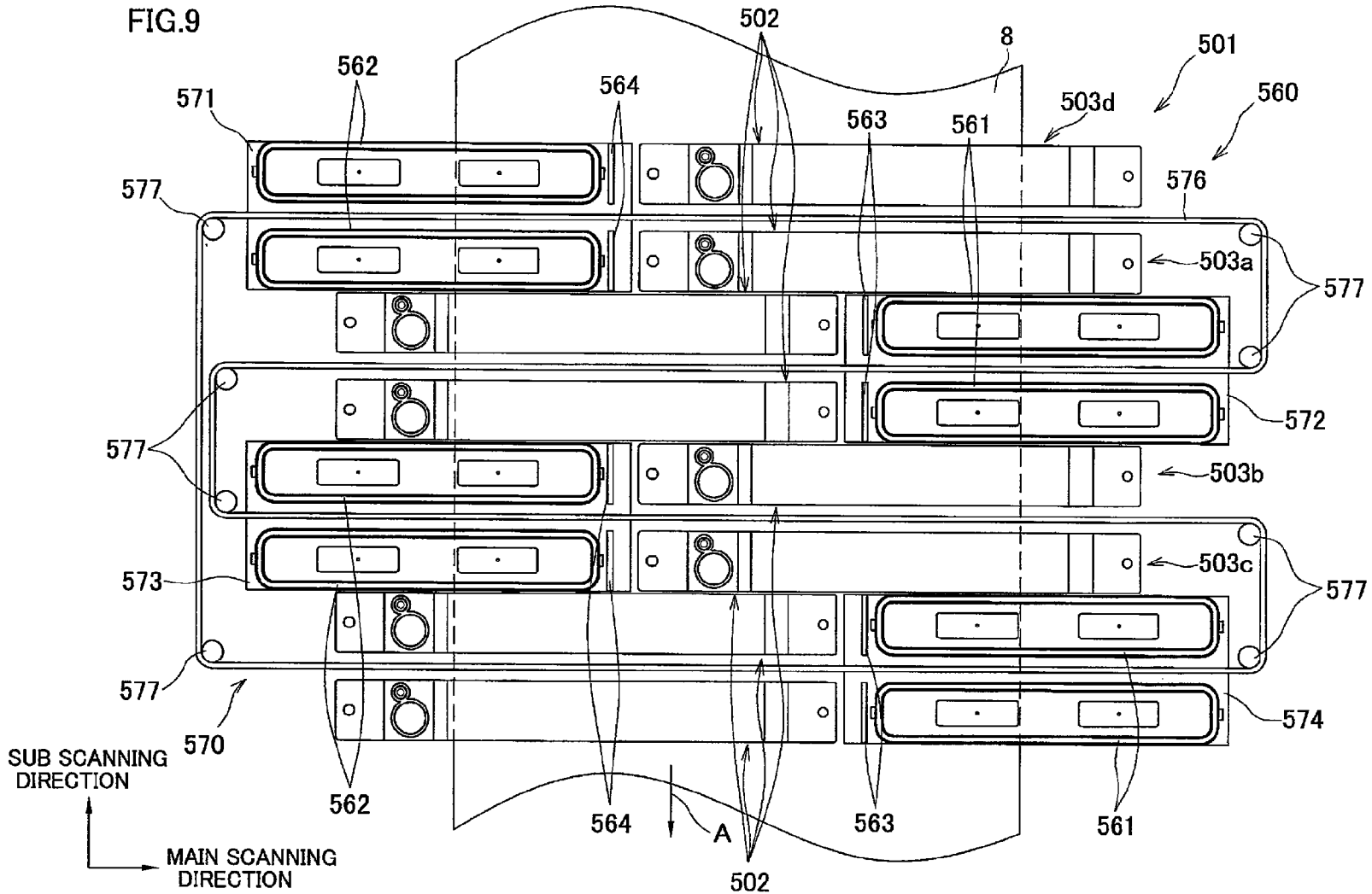
FIG. 9 is a plan view of an essential part of an ink-jet printer according to a fourth embodiment of the present invention.

Next, an ink-jet printer 401 according to a third embodiment of the present invention will be described below with reference to FIG. 8. FIG. 9 is a plan view of an essential part of an ink-jet printer according to a fourth embodiment of the present invention.

In the ink-jet printer 501 of this embodiment, arrangement of eight ink-jet heads 502 is slightly different from the arrangement of the eight ink-jet heads 402 of the third embodiment. Accordingly, arrangement of eight caps 561, 562 and eight wipers 563, 564 is also different from the arrangement of the eight caps 461, 462 and the eight wipers 463, 464 of the third embodiment. In addition, a maintenance unit 560 of the ink-jet printer 501 has a movement mechanism 570 which is slightly different from the movement mechanism 470 of the third embodiment. Except for the above, the fourth embodiment is the same as the third embodiment. Structures of ink-jet heads 502, caps 561, 562, and wipers 563, 564 are the same as in the third embodiment, but only arrangements thereof are different from in the third embodiment. The same members as of the third embodiment will be denoted by the same reference signs without specific descriptions thereof.

As shown in FIG. 9, the eight ink-jet heads 502 of this embodiment are arranged in such a manner that the ink ejection faces 4 form two rows each including four ink ejection faces 4 which are arranged side by side along the sub scanning direction and in addition the ink ejection faces included in different rows do not overlap each other with respect to the main scanning direction. The eight ink-jet heads 502 are divided into three head groups 503*a*, 503*b*, and 503*c*, and a head group 503*d*. Each of the three head groups 503*a*, 503*b*, and 503*c* includes two ink-jet heads 502 whose ink ejection faces 4 are adjacent to each other with respect to the sub scanning direction and belong to different rows. The head group 503*d* includes two ink-jet heads 502 which sandwich therebetween the three head groups 503*a*, 503*b*, and 503*c* with respect to the sub scanning direction.

The three head groups 503*a*, 503*b*, and 503*c* are arranged side by side along the sub scanning direction. One (included in the left row in FIG. 9) of the two ink-jet heads 502 in the head group 503*a* and one of the two ink-jet heads 502 in the head group 503*b* are located in positions which are the same with respect to the main scanning direction and adjacent to each other with respect to the sub scanning direction. The other (included in the right row in FIG. 9) of the two ink-jet heads 502 in the head group 503*b* and the other of the two ink-jet heads 502 in the head group 503*c* are located in positions which are the same with respect to the main scanning direction and adjacent to each other with respect to the sub scanning direction.

Consequently, two caps 561, 562 and two wipers 563, 564 associated with two adjacent ink-jet heads 502 which belong to neighboring two of the head groups 503*a*, 503*b*, and 503*c* can be disposed at positions which are the same with respect to the main scanning direction and adjacent to each other with respect to the sub scanning direction.

Among all the ink-jet heads 502 belonging to the head groups 503*a*, 503*b*, and 503*c*, the two ink-jet heads 502 which are located outermost with respect to the sub scanning direction, and the two ink-jet heads 502 neighboring these ink-jet heads 502 and belonging to the head group 502*d*, are disposed at positions which are the same with respect to the main scanning direction.

Consequently, two caps 562 and two wipers 564 associated with the other (included in the right row in FIG. 9) one of the ink-jet heads 502 in the head group 503*d*, and the ink-jet head 502 in the head group 503*a* neighboring the above-mentioned ink-jet head 502, can be disposed at positions which are the same with respect to the main scanning direction and adjacent to each other with respect to the sub scanning direction. The same is applied to two caps 561 and two wipers 563 associated with one (included in the left row in FIG. 9) of the ink-jet heads 502 in the head group 503*d*, and the ink-jet head 502 in the head group 503*c* neighboring the above-mentioned ink-jet head 502.

The two ink-jet heads 502 belonging to each of the head groups 503*a*, 503*b*, 503*c*, and 503*d* have their ink ejection faces 4 overlap each other along the sub scanning direction, which is the same in the fourth embodiment. The four head groups 503*a*, 503*b*, 503*c*, and 503*d* eject ink of different colors. In this embodiment, the three head groups 503*a*, 503*b*, and 503*c* eject black ink, magenta ink, and cyan ink, while the head group 503*d* ejects yellow ink.

The maintenance unit 560 has eight caps 561 and 562, eight wipers 563 and 564, and a movement mechanism 570. The eight caps 561 and 562, and the eight wipers 563 and 564 correspond to the eight ink-jet heads 502, respectively. The movement mechanism 570 moves the respective caps 561, 562 and the respective wipers 563, 564 in the main scanning direction.

The movement mechanism 570 has eight rollers 577, one belt 576 which spans the rollers 577, and four support plates 571 to 574 coupled with the belt 576. The eight rollers 577 are arranged in such a manner that portions of the belt 576 extending in the main scanning direction are disposed in parallel with each other, in positions among the three head groups 503*a*, 503*b*, a position between the head group 503*a* and the other ink-jet head 502 in the head group 503*d*, and at a position between the head group 503*c* and the one ink-jet head 502 in the head group 503*d*, with respect to the sub scanning direction.

The support plate 571 is positioned so as to overlap, with respect to the main scanning direction, two of the other ink-jet heads 502 (included in the right row in FIG. 9) belonging to the two head groups 503*a* and 503*d*, and in addition so as to overlap, with respect to the sub scanning direction, two of the one ink-jet heads 502 (included in the left row in FIG. 9) belonging to the two head groups 503*a* and 503*d*. The support plate 571 supports caps 562 and wipers 564 associated with two of the other ink-jet heads 502 belonging to the two head groups 503*a* and 503*d*. The support plate 571 is coupled with a portion of the belt 576 extending in the main scanning direction.

The support plate 572 is positioned so as to overlap, with respect to the main scanning direction, two of the one ink-jet heads 502 belonging to the two head groups 503*a* and 503*b*, and in addition so as to overlap, with respect to the sub scanning direction, two of the other ink-jet heads 502 belonging to the two head groups 503*a* and 503*b*. The support plate 572 supports caps 561 and wipers 563 associated with two of the one ink-jet heads 502 belonging to the two head groups 503*a* and 503*b*. The support plate 572 is coupled with a portion of the belt 576 extending in the main scanning direction.

The support plate 573 is positioned so as to overlap, with respect to the main scanning direction, two of the other ink-jet heads 502 belonging to the two head groups 503*b* and 503*c*, and in addition so as to overlap, with respect to the sub scanning direction, two of the one ink-jet heads 502 belonging to the two head groups 503*b* and 503*c*. The support plate 573 supports caps 562 and wipers 564 associated with two of the other ink-jet heads 502 belonging to the two head groups 503*b* and 503*c*. The support plate 573 is coupled with a portion of the belt 576 extending in the main scanning direction.

The support plate 574 is positioned so as to overlap, with respect to the main scanning direction, two of the one ink-jet heads 502 belonging to the two head groups 503*c* and 503*d*, and in addition so as to overlap, with respect to the sub scanning direction, two of the other ink-jet heads 502 belonging to the two head groups 503*c* and 503*d*. The support plate 573 supports caps 561 and wipers 563 associated with two of the one ink-jet heads 502 belonging to the two head groups 503*c* and 503*d*. The support plate 573 is coupled with a portion of the belt 576 extending in the main scanning direction.

In this way, it is possible to move the four support plates 571 to 574 each of which supports two caps 561 (or 562) and two wipers 563 (or 564) associated with two ink-jet heads 502. In addition, as compared with in the second embodiment, a less number of portions of the belt 576 extending in the main scanning direction are positioned between neighboring ink-jet heads 502, which can simplify the structure of the movement mechanism 570.

With the maintenance unit 560 having the above-described structure, when the drive motor 95 rotates one (upper left one in FIG. 9) roller 577 in the clockwise direction in FIG. 9, the four caps 561 and the four wipers 563 mounted on the two support plates 572 and 574 move together with the support plates 572 and 574 from the withdrawal position (as shown in FIG. 9), leftward in FIG. 9 along the main scanning direction, while the four caps 562 and the four wipers 564 mounted on the two support plates 571 and 573 move together with the support plates 571 and 573 from the withdrawal position, rightward in FIG. 9 along the main scanning direction. Thus, all the caps 561, 562, and all the wipers 563, 564 can be moved to a maintenance position opposed to the ink ejection faces 4.

At this time, each of the wipers 563, 564 moves from an inner end portion of the ink ejection face 4 of the corresponding ink-jet head 502 with respect to the main scanning direction (one end of the outside region 4*c*) toward an outer end portion thereof with respect to the main scanning direction, and stops at the outer end portion of the ink ejection face 4 (the other end of the outside region 4*c*). Like in the first embodiment, in a case where a width of a paper with respect to the main scanning direction is smaller than a width of the belt 8 with respect to the main scanning direction, the outer end portion of the ink ejection face 4 at which the wiper 563, 564 stops is in a position which overlaps an outside region of the belt 8 with respect to the vertical direction. In a case where a width of a paper with respect to the main scanning direction is larger than a width of the belt 8 with respect to the main scanning direction, the outer end portion of the ink ejection face 4 at which the wiper 563, 564 stops is in a position which overlaps, with respect to the vertical direction, an outside region of a conveyance region where the paper is conveyed (i.e., a region outside the width of the paper with respect to the main scanning direction). This can suppress contamination of the paper and the paper conveyance mechanism 10, and more particularly the belt 8, even when ink drops from an ink pool which is formed of ink collected by the wipers 563 and 564.

On the other hand, when one roller 577 is rotated in the counterclockwise direction in FIG. 9, the four caps 561 and the four wipers 563 move together with the two support plates 572 and 574 from the maintenance position opposed to the corresponding ink ejection faces 4, rightward in FIG. 9 along the main scanning direction, while the four caps 562 and the four wipers 564 move together with the two support plates 571 and 573 from the maintenance position opposed to the corresponding ink ejection faces 4, leftward in FIG. 9 along the main scanning direction. Thus, all the caps 561, 562, and all the wipers 563, 564 can be moved to the withdrawal position not opposed to the ink ejection faces 4.

In this embodiment, like this, the caps 561, 562 and the wipers 563, 564 associated with two ink-jet heads 502 belonging to each of the head groups 503*a*, 503*b*, 503*c*, and 503*d* are movable in opposite directions with respect to the main scanning direction. Therefore, the same maintenance operation as in the first embodiment can be performed by the maintenance unit 560 of this embodiment.

In the ink-jet printer 501 of this embodiment, the eight ink-jet heads 502 are arranged in such a manner that the ink ejection faces 4 of the eight ink-jet heads 502 form two rows each including four ink ejection faces 4 which are arranged side by side along the sub scanning direction and in addition the ink ejection faces 4 included in different rows do not overlap each other with respect to the main scanning direction. However, when the wipers 563 and 564 wipe the ink ejection faces 4, two wipers 563 and 564 associated with two ink ejection faces 4 belonging to different rows move along the main scanning direction from the inner end portions of the ink ejection faces 4 to positions at which the wipers 563, 564 overlap, with respect to the vertical direction, the outside region of the paper conveyance region of the paper conveyance mechanism 10 and the outside region of the paper conveyance mechanism 10. This can suppress contamination of the paper and the paper conveyance mechanism 10, and more particularly the belt 8, even when ink drops from an ink pool which is formed of ink collected by the wipers 563 and 564.

Moreover, even though free spaces are formed in regions neighboring the ink-jet heads 502 belonging to the respective head groups 503*a*, 503*b*, 503*c*, and 503*d* with respect to the main scanning direction, the eight caps 561, 562 and the eight wipers 563, 564 are positioned in these spaces. Therefore, the ink-jet printer 501 can be downsized. In addition, by making one belt 576 travel, all of the caps 561, 562, and all of the wipers 563, 564 can be moved from the withdrawal position to the maintenance position and from the maintenance position to the withdrawal position. Therefore, a structure of the movement mechanism 570 can be simplified.

While some preferred embodiments of the present invention have been described above, the present invention should not be construed to be limited to the above-described embodiments. Various modifications may be made without departing from the spirit and scope of the invention as defined by the appended claims. For example, in the above-described embodiments, two ink-jet heads which eject ink of the same color are arranged in such a manner that when they eject ink to form an image, continuous printing can be made without a break with respect to the main scanning direction. However, it may also be possible that the two ink-jet heads do not overlap each other with respect to the sub scanning direction so that, when an image is formed, printing does not continue but has a break with respect to the main scanning direction. In addition, in the respective embodiments, the movement mechanism may move the cap in a direction different from the main scanning direction with respect to the in-plane direction of the ink ejection face, between the maintenance position opposed to the ink ejection face and the withdrawal position not opposed to the ink ejection face. Moreover, in the respective embodiments, the ink-jet printer may not have the caps. Further, in the second and third embodiments, the two ink-jet heads forming the head group eject ink of the same color, but they may eject different types of ink. Still further, in the respective embodiments, it may be possible that the movement mechanism has a plurality of support members which independently support wipers and caps so that the wipers and the caps are moved separately and/or together.

Still further, in the respective embodiments, in a case where a width of a paper with respect to the main scanning direction is smaller than a width of the belt 8 with respect to the main scanning direction, a point for the wiper to end its wiping operation on the ink ejection face is in a position which overlaps an outside region of the belt 8 with respect to the vertical direction. In a case where a width of a paper with respect to the main scanning direction is larger than a width of the belt 8 with respect to the main scanning direction, a point for the wiper to end its wiping operation on the ink ejection face is in a position which overlaps an outside region of the conveyance region where the paper is conveyed, with respect to the vertical direction. However, in a case where a width of a paper with respect to the main scanning direction is smaller than a width of the belt 8 with respect to the main scanning direction, a point for the wiper to end its wiping operation on the ink ejection face may be in a position which overlaps only the outside region of the conveyance region where the paper is conveyed, with respect to the vertical direction. In such a case, contamination of the paper alone can be suppressed. Moreover, in a case where a width of a paper with respect to the main scanning direction is larger than a width of the belt 8 with respect to the main scanning direction, a point for the wiper to end its wiping operation on the ink ejection face may be in a position which overlaps only the outside region of the belt 8 with respect to the vertical direction. In such a case, contamination of the belt 8 alone can be suppressed.

Still further, in the respective embodiments, one belt is used to move caps and wipers associated with two ink-jet heads belonging to each head group in opposite directions with respect to the main scanning direction. However, it may be possible to use a plurality of belts to move caps and wipers on a head group basis or on an ink-jet head basis.

Still further, in the respective embodiments, the paper conveyance mechanism 10 conveys a paper on the belt 8. However, it may be possible that a plurality of rollers elongated in the main scanning direction are arranged side by side along the sub scanning direction and a paper is conveyed thereon.

Still further, in the respective embodiments, the maintenance unit movement controller 106 makes a control to drive the movement mechanism 70 so that the wiper 63, 64 is moved from the inner end portion to the outer end portion of the ink ejection face 4 of the corresponding ink-jet head 2 with respect to the main scanning direction. However, in a case where a whole extent of movement of the wiper 63, 64 which can be made by the movement mechanism 70 is from the inner end portion to the outer end portion of the ink ejection face 4 of the corresponding ink-jet head 2 with respect to the main scanning direction, it may be possible to provide, instead of the maintenance unit movement controller 106, only a switch which moves the movement mechanism 70 to either one of the inner end portion and the outer end portion.

Still further, the above-described embodiments are examples of application of the present invention to an ink-jet printer including a plurality of ink-jet heads which eject ink from nozzles. However, such an ink-jet head is not the only thing to which the present invention is applicable. For example, the present invention may be applied to various liquid ejection apparatus including a plurality of liquid ejection heads for ejecting a conductive paste to form a fine wiring pattern on a substrate, for ejecting an organic luminescent material to a substrate to form a high-resolution display, and for ejecting optical plastics to a substrate to form a very small electronic device such as an optical waveguide.

While this invention has been described in conjunction with the specific embodiments outlined above, it is evident that many alternatives, modifications and variations will be apparent to those skilled in the art. Accordingly, the preferred embodiments of the invention as set forth above are intended to be illustrative, not limiting. Various changes may be made without departing from the spirit and scope of the invention as defined in the following claims.

What is claimed is:

1. An image recording apparatus comprising:

a plurality of liquid ejection heads respectively having ejection faces which are arranged in such a manner that the ejection faces form two rows extending in one direction and in addition two of the ejection faces included in different rows do not overlap each other along a direction perpendicular to the one direction with respect to an in-plane direction of the ejection faces, the plurality of liquid ejection heads being divided into one or more head groups each including two of the liquid ejection heads corresponding to the different rows;

a recording medium conveyance mechanism which conveys a recording medium in the one direction while making the recording medium opposed to the ejection faces;

a plurality of wipers which wipe the ejection faces of the liquid ejection heads; and a movement means which moves two of the wipers for wiping two ejection faces of the two liquid ejection heads belonging to each head group, simultaneously in opposite directions along the perpendicular direction while keeping the two wipers in contact with the ejection faces, in such a manner that each of the wipers moves outward from a region where no droplet is ejected to a position which overlaps, along the vertical direction, at least either one of an outside region of a conveyance region where the recording medium is conveyed by the recording medium conveyance mechanism and an outside region of the recording medium conveyance mechanism.

2. The image recording apparatus according to claim 1, wherein a point at which wiping of the ejection face by the wiper ends is an outer end portion of the ejection face located in a region where no droplet is ejected.

3. The image recording apparatus according to claim 2, wherein the outer end portion of the ejection face is opposed to a region which is an outside region of a conveyance region where the recording medium is conveyed by the recording medium conveyance mechanism and also is an outside region of the recording medium conveyance mechanism.

4. The image recording apparatus according to claim 1, wherein, when in a wiper withdrawal position not opposed to the ejection face, the wiper associated with one of the liquid ejection heads belonging to each head group is located in a position overlapping the one liquid ejection head along the perpendicular direction and also overlapping the other of the liquid ejection heads along the one direction, while, when in the wiper withdrawal, the wiper associated with the other liquid ejection head is located in a position overlapping the other liquid ejection head along the perpendicular direction and also overlapping the one liquid ejection head along the one direction.

5. The image recording apparatus according to claim 4, wherein the plurality of liquid ejection heads are divided into two head groups corresponding to the different rows and each including two or more liquid ejection heads, the two or more liquid ejection heads being located in the same position with respect to the perpendicular direction and having the ejection faces thereof adjacent to each other.

6. The image recording apparatus according to claim 5, wherein:

the plurality of liquid ejection heads belonging to each head group eject ink of different colors; and the plurality of wipers are associated with the respective liquid ejection heads belonging to each head group and disposed at a distance from each other with respect to the one direction.

7. The image recording apparatus according to claim 6, wherein the plurality of liquid ejection heads are divided into a plurality of head groups each including two liquid ejection heads which belong to the different rows and whose ejection faces are adjacent to each other with respect to the one direction.

8. The image recording apparatus according to claim 1, wherein the movement means has a plurality of rollers and a belt which spans the plurality of rollers, the belt being coupled with all of the wipers so that as the belt travels the wipers are moved from the wiper withdrawal position in the perpendicular direction.

* * * * *